US007167671B2

(12) United States Patent
Serizawa et al.

(10) Patent No.: US 7,167,671 B2
(45) Date of Patent: Jan. 23, 2007

(54) TONER DRAINING MECHANISM, COLLECTED TONER CONTAINER, AND IMAGE FORMING APPARATUS

(75) Inventors: Takashi Serizawa, Tokyo (JP); Eisaku Muto, Tokyo (JP); Yukiyoshi Oda, Tokyo (JP); Junichi Ito, Tokyo (JP)

(73) Assignee: Oki Data Corporation, Tokyo (JP)

( * ) Notice: Subject to any disclaimer, the term of this patent is extended or adjusted under 35 U.S.C. 154(b) by 151 days.

(21) Appl. No.: 10/855,774

(22) Filed: May 28, 2004

(65) Prior Publication Data

US 2005/0008416 A1 Jan. 13, 2005

(30) Foreign Application Priority Data

May 30, 2003 (JP) ..... 2003-154144

(51) Int. Cl.
*G03G 21/12* (2006.01)
*G03G 21/10* (2006.01)

(52) U.S. Cl. ..... 399/360; 399/358

(58) Field of Classification Search ..... 399/358, 399/359, 360

See application file for complete search history.

(56) References Cited

U.S. PATENT DOCUMENTS 4,941,022 A * 7/1990 Ohmura et al. ..... 399/358
5,383,578 A * 1/1995 Nishimura ..... 399/360
5,740,500 A * 4/1998 Hashimoto ..... 399/114
6,266,511 B1 * 7/2001 Murakami et al. ..... 399/358
6,782,235 B1 * 8/2004 Serizawa et al. ..... 399/360

FOREIGN PATENT DOCUMENTS

JP 06-242710 * 9/1994
JP 09-237023 * 9/1997
JP 2002-169439 * 6/2002

* cited by examiner

*Primary Examiner*—Sandra L. Brase
(74) *Attorney, Agent, or Firm*—Rabin & Berdo, PC

(57) ABSTRACT

A toner draining mechanism has a hollow member and a conveying member which is arranged in the hollow member and conveys toner. A toner draining port for draining the conveyed toner is formed in the hollow member. The toner draining port is formed above a bottom surface of the hollow member. Therefore, when a toner cartridge is exchanged, the toner near the toner draining port does not drop into an image forming apparatus. Thus, it is possible to prevent the toner from dirtying the inside of the image forming apparatus.

32 Claims, 22 Drawing Sheets

| h1 [mm] / α [mm] | 2.0 | 2.5 (FLUSH SURFACE) | 3.0 | 3.2 | 3.4 |
|---|---|---|---|---|---|
| 1.7 | × | × | △ | △ | △ |
| 2.0 | × | × | ○ | ○ | ○ |
| 2.3(1/2β) | × | × | ○ | ○ | ○ |
| 2.6 | × | × | ○ | ○ | ○ |
| 2.9 | × | △ | ○ | ○ | ○ |
| 3.2 | △ | △ | ○ | ○ | ○ |
| 3.5 | △ | △ | ○ | ○ | ○ |

TONER DRAINING MECHANISM, COLLECTED TONER CONTAINER, AND IMAGE FORMING APPARATUS

BACKGROUND OF THE INVENTION

1. Field of the Invention

The invention relates to a toner draining mechanism, a collected toner container, and an image forming apparatus.

2. Related Background Art

Hitherto, in an image forming apparatus such as an electrophotographic type printer, a copying apparatus, a facsimile apparatus, or the like, a surface of a photosensitive drum is uniformly and evenly charged, the charged surface is exposed to thereby form an electrostatic latent image, and toner is deposited onto the electrostatic latent image to thereby form a toner image. After the toner image is transferred onto a sheet, it is fixed and an image is formed.

A small amount of toner remains on the surface of the photosensitive drum after the transfer of the toner image. Therefore, a cleaning blade is pressed onto the photosensitive drum and the residual toner is removed by the cleaning blade. A toner draining mechanism is arranged in a position adjacent to the cleaning blade. The toner draining mechanism has a cylindrical conveying path and is provided with a spiral (screw conveyer) for conveying the toner to the conveying path. Therefore, by rotating the spiral, the toner is conveyed and dropped into a drain toner vessel of a toner cartridge from a toner draining port formed in the lower surface of the conveying path, so that it can be collected (for example, refer to JP-A-2000-284660).

However, in the above conventional toner draining mechanism, since vibration or the like is applied to the conveying path when the drain toner vessel to drain the toner collected by the drain toner vessel is removed, the toner near the toner draining port drops into the image forming apparatus and dirties the inside of the image forming apparatus.

SUMMARY OF THE INVENTION

It is an object of the invention to solve the problem of the conventional toner draining mechanism and provide a toner draining mechanism, a collected toner container, and an image forming apparatus, in which such a problem that toner near a toner draining port drops into the image forming apparatus and dirties the inside of the image forming apparatus is not caused.

According to the present invention, there is provided a toner draining mechanism comprising a hollow member and a conveying member which is arranged in the hollow member and conveys toner, wherein a toner draining port for draining the toner conveyed by the conveying member is formed in the hollow member, and the toner draining port is formed above a bottom surface of the hollow member.

In the toner draining mechanism, an inclined surface may be formed between the toner draining port and the bottom surface.

Further, according to the present invention, there is provided another toner draining mechanism comprising a hollow member and a conveying member which is arranged in the hollow member and conveys toner, wherein a toner draining port for draining the toner conveyed by the conveying member is formed in the hollow member, and the toner draining port is formed so that the conveyed toner is drained after the toner reaches a predetermined amount.

Furthermore, according to the present invention, there is provided another toner draining mechanism comprising:

a hollow member;

a conveying member which is arranged in the hollow member and conveys toner;

a cover member which is slidably attached to the hollow member and opens/blocks a toner draining port of the hollow member for draining the toner conveyed by the conveying member; and an urging member which urges the cover member in such a direction as to block the toner draining port.

Further, according to the present invention, there is provided an image forming apparatus comprising:

an image forming unit which forms a toner image;

a toner collecting unit which collects toner that is not used when the toner image is formed;

a collected toner container which contains the toner collected by the toner collecting unit; and a toner draining mechanism, wherein the toner draining mechanism comprises a hollow member and a conveying member which is arranged in the hollow member and conveys toner, wherein a toner draining port for draining the toner conveyed by the conveying member is formed in the hollow member, and the toner draining port is formed above a bottom surface of the hollow member, wherein the toner collected by the toner collecting unit is sent to the collected toner container through the toner draining mechanism.

In the image forming apparatus, the collected toner container may be detachably connected to the toner draining mechanism.

Moreover, according to the present invention, there is provided another image forming apparatus comprising:

an image forming unit which forms a toner image;

a toner collecting unit which collects toner that is not used when the toner image is formed;

a collected toner container which contains the toner collected by the toner collecting unit; and a toner draining mechanism, wherein the toner draining mechanism comprises a hollow member and a conveying member which is arranged in the hollow member and conveys toner, wherein a toner draining port for draining the toner conveyed by the conveying member is formed in the hollow member, and the toner draining port is formed so that the conveyed toner is drained after the toner reaches a predetermined amount, wherein the toner collected by the toner collecting unit is sent to the collected toner container through the toner draining mechanism.

In the image forming apparatus, the collected toner container may also be detachably connected to the toner draining mechanism.

Furthermore, according to the present invention, there is provided another image forming apparatus comprising:

an image forming unit which forms a toner image;

a toner collecting unit which collects toner that is not used when the toner image is formed; and a collected toner container which contains the toner collected by the toner collecting unit; and a toner draining mechanism, wherein the toner draining mechanism comprises a hollow member; a conveying member which is arranged in the hollow member and conveys toner; a cover member which is slidably attached to the hollow member and opens/blocks a toner draining port of the hollow member for draining the toner conveyed by the conveying member; and an urging member which urges the cover member in such a direction as to block the toner draining port, wherein the toner collected by the toner collecting unit is sent to the collected toner container through the toner draining mechanism.

In the image forming apparatus, the collected toner container may also be detachably connected to the toner draining mechanism.

Further, according to the present invention, there is provided another image forming apparatus comprising:

a toner draining mechanism including a barrel member into which collected toner is guided, toner conveying means which is arranged in the barrel member and conveys the guided toner to a front edge side of the barrel member, and a toner draining port which is opened in the front edge portion of the barrel member and causes the conveyed toner to drop; and a collected toner container which is exchangeably attached to the front edge portion including the toner draining port of the barrel member and contains the dropped toner, wherein the toner draining mechanism further has a blocking barrel member which is attached onto the barrel member and blocks the toner draining port and an pressing member which presses the blocking barrel member to the front edge portion side so as to block the toner draining port, and the collected toner container has an attaching mechanism including an introducing opening into which the front edge portion is introduced and a contact portion which consists of an edge portion that specifies the introducing opening and allows the blocking barrel member to be slid on the barrel member against an pressure force of the pressing member so as to open the toner draining port.

The image forming apparatus may further comprise a cartridge for forming an image, and wherein the toner draining mechanism is provided for the cartridge.

Moreover, according to the present invention, there is provided another image forming apparatus comprising:

a toner draining mechanism including a barrel member into which collected toner is guided, toner conveying means which is arranged in the barrel member and conveys the guided toner to a front edge side of the barrel member, and a toner draining port which is opened in the front edge portion of the barrel member and causes the conveyed toner to drop; and a collected toner container which is exchangeably attached to the front edge portion including the toner draining port of the barrel member and contains the dropped toner, wherein the toner draining mechanism further has a blocking barrel member which is slidably attached onto the barrel member and blocks the toner draining port and an elastic member which elastically presses the blocking barrel member to the front edge portion side so as to block the toner draining port, and the collected toner container has an attaching mechanism including an introducing opening into which the front edge portion is introduced and a contact portion which consists of an edge portion that specifies the introducing opening and allows the blocking barrel member to be slid on the barrel member against an elastic force of the elastic member so as to open the toner draining port.

The image forming apparatus may also further comprise a cartridge for forming an image, and wherein the toner draining mechanism is provided for the cartridge.

Furthermore, according to the present invention, there is provided a collected toner container which is exchangeably attached to a toner draining mechanism and contains toner which drops, the toner draining mechanism comprising:

a barrel member into which the collected toner is guided;

toner conveying means which is arranged in the barrel member and conveys the guided toner to a front edge side of the barrel member;

a toner draining port which is opened in the front edge portion of the barrel member and causes the conveyed toner to drop;

a blocking barrel member which is slidably attached onto the barrel member and blocks the toner draining port; and an elastic member which elastically presses the barrel member to the front edge portion side so as to block the toner draining port, wherein the collected toner container comprises an attaching mechanism including:

an introducing opening into which the front edge portion is introduced; and a contact portion-which consists of an edge portion that specifies the introducing opening and allows the blocking barrel member to be slid on the barrel member against an elastic force of the elastic member so as to open the toner draining port.

In the collected toner container, the attaching mechanism includes a rotational cover member which is pivotally supported in an inner portion of the introducing opening so that an upper edge is rotatable, blocks the introducing opening through elastic member, and is rotated in an opening direction against the elastic force of the elastic member by a pressing force of the front edge of the barrel member introduced to the introducing opening.

Further, in collected toner container, the attaching mechanism may further include a cylindrical portion into which the front edge portion of the barrel member introduced to the introducing opening is inserted and which has a toner dropping port that is opened downward;

a rotary cap which is rotatably arranged in the cylindrical portion; and cap rotating means which rotates the rotary cap by a predetermined amount by the insertion of the front edge portion into the cylindrical portion, and the rotary cap has an opening which is matched with the toner dropping port by the rotation of the predetermined amount and allows the toner to drop.

Furthermore, in the collected toner container, the attaching mechanism may more include a cylindrical portion into which the front edge portion of the barrel member introduced to the introducing opening is inserted and which has a toner dropping port that is opened downward;

a mobile blocking cover which is arranged to the cylindrical portion so as to be movable in its axial direction and blocks the toner dropping port; and cover moving means which is come into engagement with the mobile blocking cover by the insertion of the front edge portion into the cylindrical portion and moves the mobile blocking cover so as to open the toner dropping port.

As described in detail above, according to the invention, the toner draining mechanism has the hollow member and the conveying member which is arranged in the hollow member and conveys the toner.

The toner draining port to drain the toner conveyed by the conveying member is formed in the hollow member. The toner draining port is formed above the bottom surface of the hollow member.

In this case, since the toner draining port is formed above the bottom surface of the hollow member, when a toner cartridge is exchanged, the toner near the toner draining port does not drop into the image forming apparatus. Therefore, it is possible to prevent the toner from dirtying the inside of the image forming apparatus.

The above and other objects and features of the present invention will become apparent from the following detailed description and the appended claims with reference to the accompanying drawings.

DETAILED DESCRIPTION OF THE PREFERRED EMBODIMENTS

Embodiments of the invention will be described in detail hereinbelow with reference to the drawings. In this case, a printer as an image forming apparatus will be described.

Figure 1:
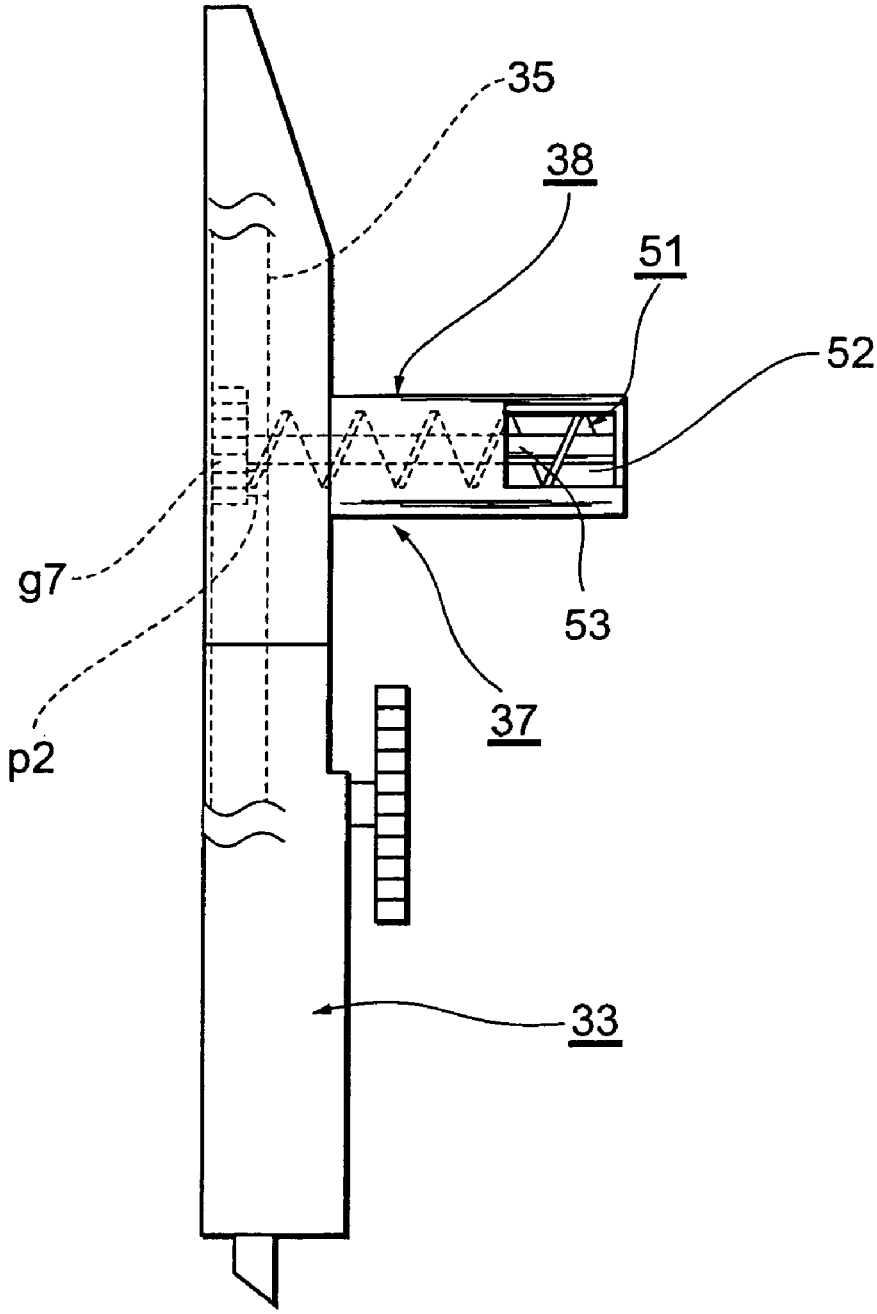
FIG. 1 is a front view of a toner draining mechanism in the first embodiment of the invention.
Figure 2:
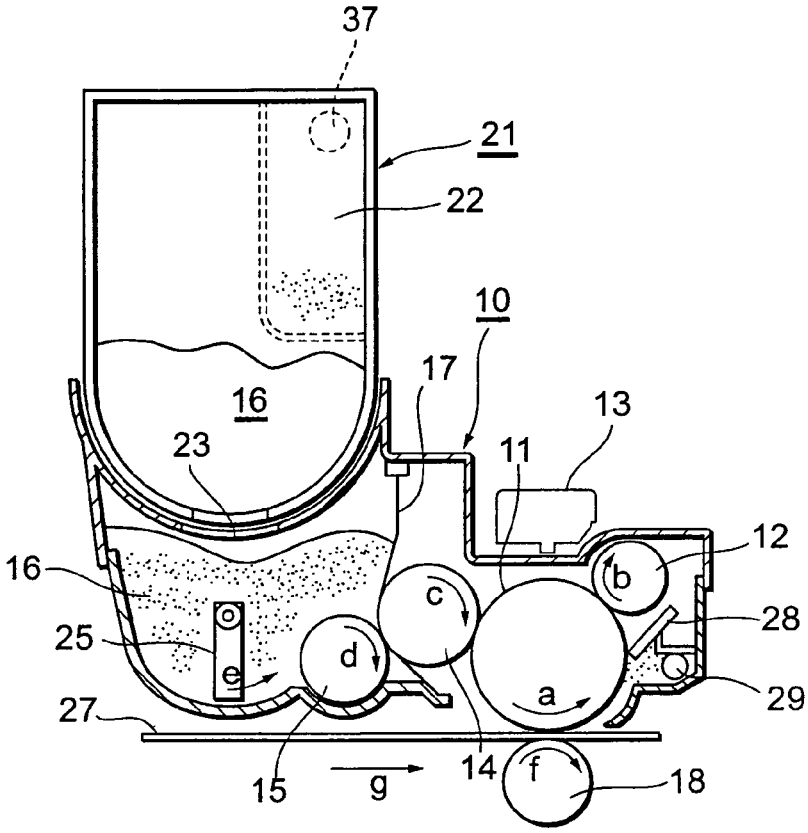
FIG. 2 is a conceptual diagram of a printer in the first embodiment of the invention.
Figure 3:
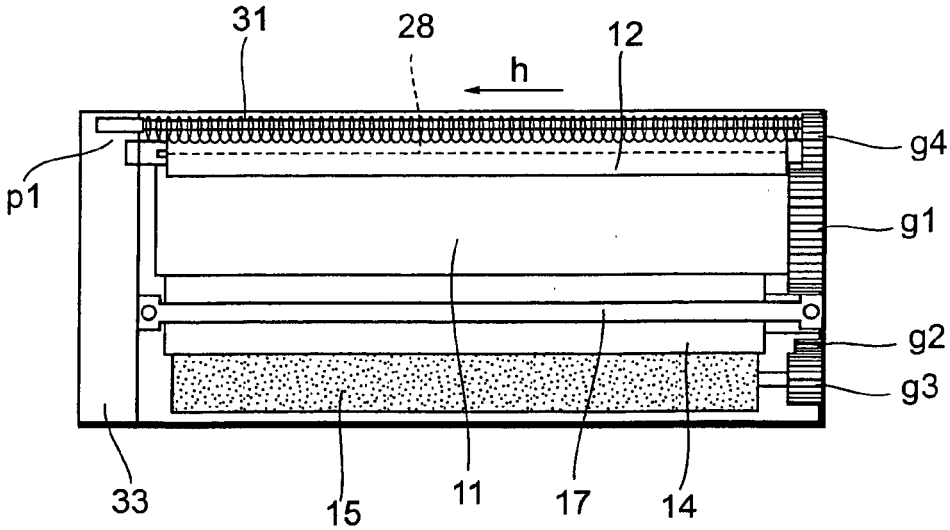
FIG. 3 is a cross sectional view showing a main section of the printer in the first embodiment of the invention.
Figure 4:
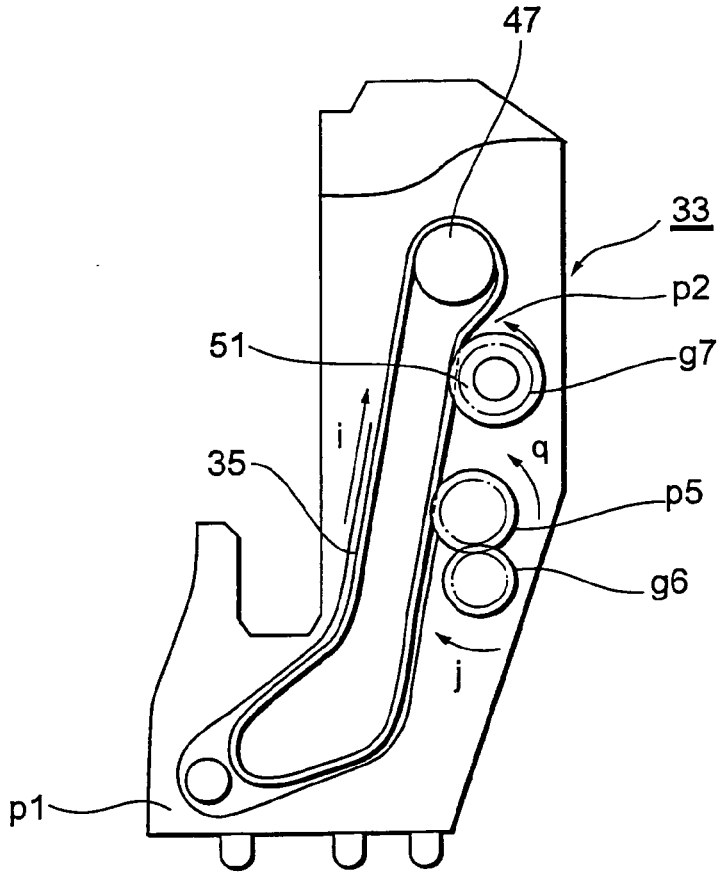
FIG. 4 is a conceptual diagram of a side panel in the first embodiment of the invention.
Figure 5:
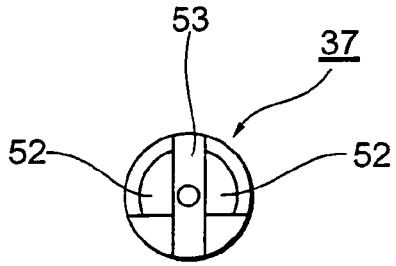
FIG. 5 is a side elevational view of the toner draining mechanism in the first embodiment of the invention.
Figure 6:
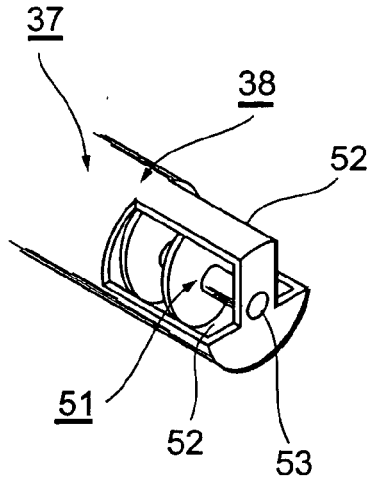
FIG. 6 is a perspective view showing a main section of the toner draining mechanism in the first embodiment of the invention.

FIG. 1 is a front view of a toner draining mechanism in the first embodiment of the invention. FIG. 2 is a conceptual diagram of the printer in the first embodiment of the invention. FIG. 3 is a cross sectional view showing a main section of the printer in the first embodiment of the invention. FIG. 4 is a conceptual diagram of a side panel in the first embodiment of the invention. FIG. 5 is a side elevational view of the toner draining mechanism in the first embodiment of the invention. FIG. 6 is a perspective view showing a main section of the toner draining mechanism in the first embodiment of the invention.

In the diagrams, reference numeral 10 denotes a drum cartridge to form an image; 11 a photosensitive drum as an image holder which is rotated in the direction shown by an arrow (a); and 12 a charging roller as a charging apparatus which is rotated in the direction shown by an arrow (b) in contact with the photosensitive drum 11. A voltage is applied to the charging roller 12 by a power source (not shown), so that the charging roller 12 causes an electric potential to be generated on the surface of the photosensitive drum 11, thereby uniformly and evenly charging the surface of the photosensitive drum 11. In place of the charging roller 12, another charging apparatus of a non-contact type such as scorotron, corotron, or the like can be used as a charging apparatus.

Reference numeral 13 denotes an LED head as an exposing apparatus for exposing the surface of the photosensitive drum 11 and forming an electrostatic latent image. In place of the LED head 13, another exposing apparatus such as a laser or the like can be used as an exposing apparatus. Reference numeral 14 denotes a developing roller as a toner holder which is arranged to the photosensitive drum 11 in a contact or contactless manner and rotated in the direction shown by an arrow (c). The developing roller 14 conveys toner 16 as a developing agent to a developing area, causes the toner 16 to be deposited onto the electrostatic latent image, visualizes the electrostatic latent image, and forms a toner image. Reference numeral 15 denotes a supplying roller which is rotated in the direction shown by an arrow (d) in contact with the developing roller 14 and supplies the toner 16 to the developing roller 14. Reference numeral 17 denotes a developing blade as a toner restricting member for forming the toner 16 supplied to the developing roller 14 by the supplying roller 15 into a thin layer shape and forming a toner layer onto the developing roller 14.

Reference numeral 21 denotes a toner cartridge in which the toner 16 is held and supplies the toner 16 into the drum cartridge 10, and 22 indicates a drain toner vessel as a collected toner containing unit which is arranged in the toner cartridge 21 and encloses the toner 16 drained from the drum cartridge 10. The toner 16 in the toner cartridge 21 drops into the drum cartridge 10 through a toner supplying port 23 formed in the drum cartridge 10. An agitating member 25 is arranged in the drum cartridge 10 so as to be rotatable in the direction shown by an arrow (e), agitates the toner 16 in the drum cartridge 10, and supplies it to the supplying roller 15.

Reference numeral 18 denotes a transfer roller as a transfer apparatus which is rotatably arranged in contact with the photosensitive drum 11. A voltage is applied from a power source (not shown) to the transfer roller 18 and the transfer roller 18 is rotated in the direction shown by an arrow (f) and transfers the toner image on the photosensitive drum 11 onto a sheet 27 as a recording medium. Besides the sheet 27, an OHP sheet or the like can be used as a recording medium. As another transfer apparatus, a transfer apparatus of a non-contact corotron system can be used in place of the transfer roller 18.

The sheet 27 is conveyed in the direction shown by an arrow (g) and fed to a fixing apparatus (not shown). The toner image is fixed onto the sheet 27 by the fixing apparatus. For this purpose, the fixing apparatus comprises a heating roller whose surface is heated by the supply of heat from a power source and which heats the toner 16 of the toner image on the sheet 27 and fuses it and a pressing roller which presses the fused toner 16 onto the sheet 27.

After the transfer of the toner image, a small amount of toner 16 remains on the surface of the photosensitive drum 11. Therefore, a cleaning blade 28 as a cleaning apparatus is pressed onto the photosensitive drum 11. The remaining toner is collected and removed by the cleaning blade 28. As a cleaning apparatus, a cleaning roller, a cleaning brush, or the like which is come into contact with the photosensitive drum 11 and removes the toner 16 remaining on the photosensitive drum 11 while being rotated can be used in place of the cleaning blade 28.

A cylindrical conveying path 29 is formed in a position adjacent to a lower portion of the cleaning blade 28. A spiral 31 as a first conveying member which is made of steel and has elasticity is arranged in the conveying path 29. Therefore, by rotating the spiral 31, the toner 16 can be conveyed in the direction shown by an arrow (h) and fed to a toner entrance p1 formed near an upper edge of one side panel 33 (on the left side of the printer). A gear g1 attached to one end of the photosensitive drum 11, a gear g2 attached to one end of the developing roller 14, a gear g3 attached to one end of the supplying roller 15, a gear g4 attached to one end of the spiral 31, and the like are arranged on the other side panel (not shown) (on the right side of the printer). Rotation generated by driving a drum motor (not shown) as a driving source for main driving is transferred through the gears g1 to g4 and the like to the photosensitive drum 11, the developing roller 14, the supplying roller 15, the spiral 31, and the like. A first rotation transfer member is constructed by the gears g1 to g4.

A toner conveying belt 35 as a second conveying member formed with concave and convex teeth (not shown) on one surface is arranged in the side panel 33 so as to be freely run in the direction shown by an arrow (i). The toner is supplied from the toner entrance p1 to a toner exit p2 formed near an upper edge of the side panel 33. For this purpose, the toner conveying belt 35 is come into engagement with a running gear g5 which is rotated in the direction shown by an arrow (g). The gear g5 and a conveying motor (not shown) as a driving source for running are coupled through an idle gear g6 which is rotated in the direction shown by an arrow (j). The side panel 33 is formed by a mold. A groove to guide the toner conveying belt 35 to the side panel 33 is formed on the side panel 33. Therefore, by driving the conveying motor, the gear g5 is rotated through the idle gear g6, thereby enabling the toner conveying belt 35 to be run along the groove. In association with it, the toner 16 supplied to the toner entrance p1 is conveyed in the state where it is held by the teeth and fed to the toner exit p2. Reference numeral 47 denotes a guide roller of the toner conveying belt 35. A second rotation transfer member is constructed by the gears g5 and g6. A toner collecting unit to collect the toner 16 which is not used when the toner image is formed is constructed by the cleaning blade 28, the conveying path 29, the spiral 31, the toner conveying belt 35, and the like.

The toner conveying belt 35 is made of polyester elastomer, its width is set to 12 [mm], a height of tooth is set to 2.5 [mm], a width of tooth is set to 2.0 [mm], and a distance between the teeth is set to 2.8 [mm].

A toner draining mechanism 37 is arranged to the side panel 33 in a portion of the toner exit p2 so as to be projected into the drain toner vessel 22. The toner draining mechanism 37 has: a cylindrical portion 38 as a hollow member formed so as to be projected from the side panel 33 into the drain toner vessel 22; a spiral (screw conveyer) 51 as a third conveying member which is rotatably arranged in the cylindrical portion 38 and made of polyacetal; and a gear g7 as a third rotation transfer member which is attached to one end of the spiral 51 and come into engagement with the toner conveying belt 35 in the side panel 33. The cylindrical portion 38 has two toner draining ports 52 formed by notching right and left ends of the cylindrical portion 38 into a fan-shape for a predetermined distance from a front edge (right end in FIG. 1) to a root side (the side of the side panel 33). Reference numeral 53 denotes a shaft of the spiral 51. The drain toner vessel 22 is arranged so as to be detachable from the toner draining mechanism.

Therefore, in association with the running of the toner conveying belt 35, the toner 16 supplied to the toner exit p2 is received by a receiving member (not shown) and, thereafter, conveyed in the cylindrical portion 38 toward the front edge side in association with the rotation of the spiral 51. The toner is drained from the toner draining ports 52 and drops into the drain toner vessel 22.

The toner draining ports 52 are formed in the right and left symmetrical positions, a size of each port 52 in the vertical direction is set to 8 [mm] and its size in the axial direction is set to 8.5 [mm]. The toner draining ports 52 are formed in the lowest portion of the cylindrical portion 38, that is, in the positions which are upwardly away from the bottom surface of the cylindrical portion 38 by a distance of 4 [mm] in such a manner that after the conveyed and stored toner 16 reaches a predetermined amount, it overflows and is drained. An inner diameter of the cylindrical portion 38 is set to 12 [mm].

Since the toner draining ports 52 are formed above the bottom surface of the cylindrical portion 38 as mentioned above, when the toner cartridge 21 is removed from the printer in order to exchange the toner cartridge 21, even if vibration or the like is applied to the toner draining mechanism 37, the toner 16 near the toner draining ports 52 does not drop into the printer. Therefore, it is possible to prevent the toner from dirtying the inside of the printer.

In the embodiment, as a construction, the front edge of the spiral 51 is positioned so as to be away from the front edge of the cylindrical portion 38 by a predetermined distance.

Figure 7:
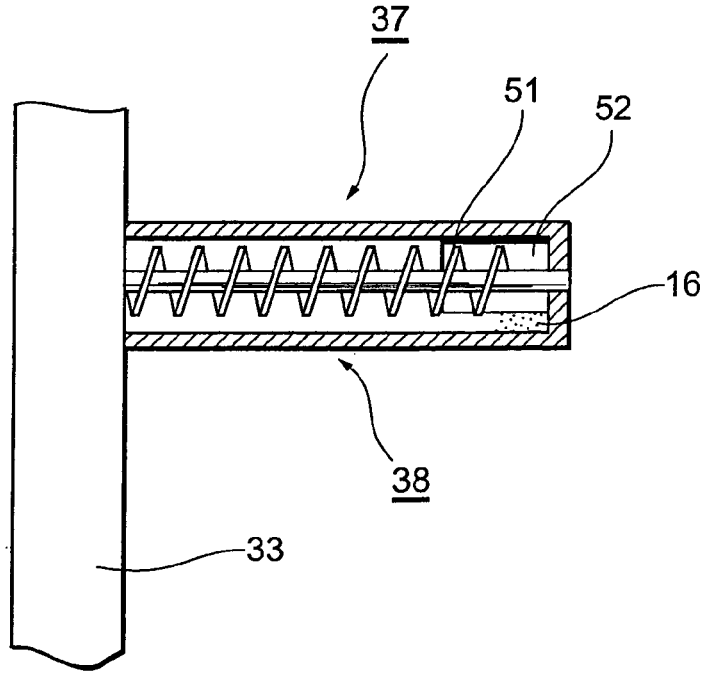
FIG. 7 is a diagram showing a state of a front edge portion of the toner draining mechanism in the first embodiment of the invention.

FIG. 7 is a diagram showing a state of a front edge portion of the toner draining mechanism in the first embodiment of the invention.

In the diagram, reference numeral 16 denotes the toner; 33 the side panel; 37 the toner draining mechanism; 38 the cylindrical portion; 51 the spiral; and 52 the toner draining port, respectively.

As shown in the diagram, since-the front edge of the effective portion of the spiral 51 is positioned so as to be away from the front edge of the cylindrical portion 38 by a distance of about 7 [mm], the toner 16 conveyed by the spiral 51 remains in the lower portion of the front edge of the cylindrical portion 38.

For example, if the toner is left for a long time (longer than one month) and remains in the lower portion of the front edge of the cylindrical portion 38 in an environment of high temperature and high humidity (28 [° C.], 80 [%]) in which flowability of the toner 16 deteriorates, the toner 16 is fixed and stuck. In this case, the toner 16 conveyed by the spiral 51 is prevented from draining from the toner draining port 52 afterward the toner 16 cannot be smoothly drained from the toner draining port 52.

Thus, the toner 16 is clogged in the cylindrical portion 38 and also in the grooves of the side panel 33 and the toner conveying belt 35 cannot be run. Therefore, the toner 16 removed by the cleaning blade 28 cannot be smoothly drained and image quality deteriorates.

The second embodiment of the invention in which the toner 16 can be smoothly drained from the toner draining port 52 and the toner 16 removed by the cleaning blade 28 can be smoothly drained in order to solve such a problem will now be described.

Figure 8:
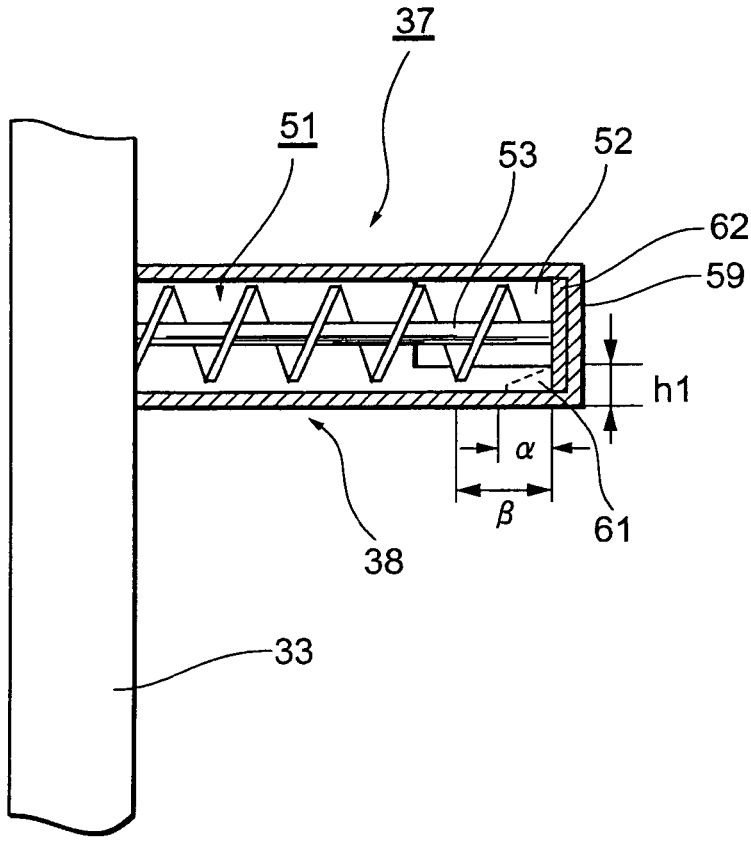
FIG. 8 is a front view of a toner draining mechanism in the second embodiment of the invention.
Figure 9:
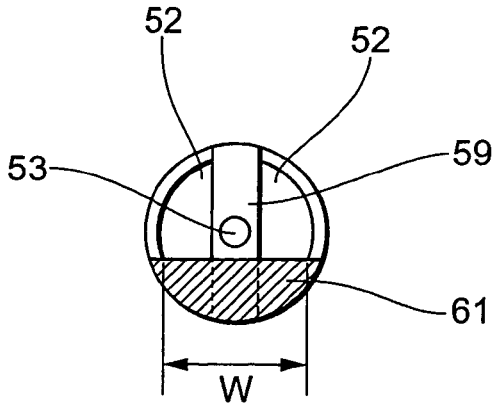
FIG. 9 is a side elevational view of the toner draining mechanism in the second embodiment of the invention.

FIG. 8 is a front view of a toner draining mechanism in the second embodiment of the invention. FIG. 9 is a side elevational view of the toner draining mechanism in the second embodiment of the invention.

In this case, a top 61 as a toner deposition suppressing member made of plastics is adhered to the lower portion of the front edge of the cylindrical portion 38 as a hollow member. The top 61 is arranged between the bottom surface of the cylindrical portion 38 and the toner draining port 52. A lower surface of the top 61 is curved along the bottom surface of the cylindrical portion 38, thereby forming an arc-shaped surface. An upper surface of the top 61 is obliquely bent upward toward the front edge side of the cylindrical portion 38 from the side panel 33 side, thereby forming an inclined surface.

It is desirable that an upper edge of the inclined surface and a lower edge of the toner draining port 52 are set to the same height so as to form a flush surface. If the upper edge of the inclined surface is higher than the lower edge of the toner draining port 52, since an opening area of the toner draining port 52 becomes small, an amount of toner 16 as a developing agent which is drained through the toner draining port 52 decreases. Thus, draining efficiency of the toner 16 deteriorates and such a phenomenon that the toner 16 remains in the cylindrical portion 38 or in the grooves of the side panel 33 occurs. If the upper edge of the inclined surface is lower than the lower edge of the toner draining port 52, since the toner 16 conveyed by the spiral 51 as a third conveying member does not immediately drop from the toner draining port 52, the drop-out of the toner is suppressed by a side wall of the toner draining port 52. Thus, the draining efficiency of the toner 16 in the toner draining mechanism 37 decreases. Reference numeral 59 denotes a supporting portion which is formed at the front edge of the cylindrical portion 38 and supports the shaft 53 and 62 indicates a holding portion which is formed in a band-shape along the supporting portion 59 and holds the top 61.

In the embodiment, a height h1 of top 61 which is expressed by a distance from the bottom surface of the cylindrical portion to the upper edge of the inclined surface is set to 3 [mm], a length a which is expressed by a size of top 61 in the axial direction on the bottom surface of the top 61 is set to 2.3 [mm], and a width w which is expressed by a size in the with direction of the top edge of the top 61 is set to 11.8 [mm], respectively.

It is assumed that a length which is expressed by a size in the axial direction of a non-spiral portion between the front edge of the effective portion of the spiral 51 as a third conveying member and the front edge of the cylindrical portion 38 (actually, the holding portion 62) is equal to $\beta$, it is desirable that the length $\alpha$ is set to about ½ of the length $\beta$. If it is set to a value which is too larger than ½, there is a risk that the top 61 is come into contact with the spiral 51. If it is set to a value which is too smaller than ⅓, an effect of the top 61 decreases, the toner 16 remains between the top 61 and the spiral 51, and the draining efficiency of the toner 16 decreases.

Since the top 61 is arranged in the lower portion of the front edge in the cylindrical portion 38 and the inclined surface is formed between the toner draining port 52 and the bottom surface of the cylindrical portion 38, the toner 16 conveyed by the spiral 51 runs up on the top 61 and is drained from the top 61. Therefore, even in the environment of the high temperature and the high humidity (28 [° C.], 80 [%]) in which the flowability of the toner 16 deteriorates, it is possible to prevent the toner 16 from remaining in the lower portion of the front edge in the cylindrical portion 38, and the toner 16 can be smoothly drained from the toner draining port 52.

Such a situation that the toner 16 conveyed by the spiral 51 is drained from the toner draining port 52 is not obstructed. Such a situation that the toner 16 is clogged in the cylindrical portion 38 and in the grooves for running the toner conveying belt 35 in the side panel 33, so that the toner conveying belt 35 cannot be run does not occur. Therefore, the toner 16 removed by the cleaning blade 28 can be smoothly drained and the image quality can be improved.

The draining state of the toner 16 at the time when the height h1 and length α of the top 61 are changed will now be described.

Figures 10, 11:
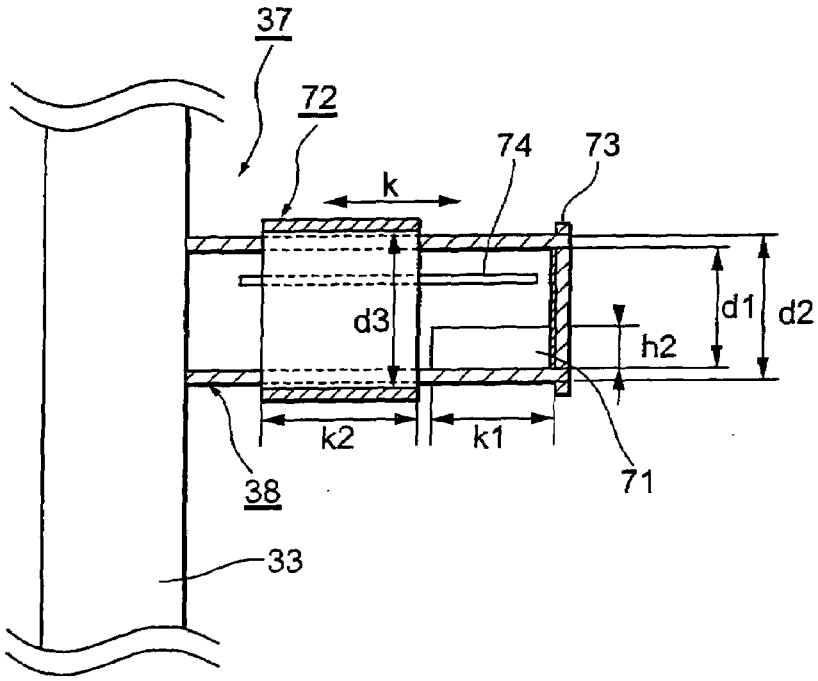
FIG. 10 is a table showing experiment results of a toner draining state in the second embodiment of the invention.
FIG. 11 is a front view showing a first state of a toner draining mechanism in the third embodiment of the invention.

FIG. 10 is a table showing experiment results, of a toner draining state in the second embodiment of the invention.

In the table, o denotes the state where the toner 16 does not remain but is preferably drained; Δ shows the state where although a small amount of toner 16 remains, the toner 16 is almost preferably drained; and x indicates the state where a large amount of toner 16 remains and is difficult to be drained.

Assuming that the height h1 is set to 3 [mm], the toner 16 does not remain or remains slightly. If the height h1 is set to 2.5 [mm], the toner 16 conveyed by the spiral 51 collides with the lower edge of the toner draining port 52 and forms a wall. Therefore, even if the length α is increased, an amount of toner 16 which remains increases.

Although the amount of the toner 16 which remains can be reduced to a certain extent by increasing the length α, the height h1 has to be set to 3 [mm] or more in order to eliminate the amount of the toner 16 which remains.

As mentioned above, since the top 61 is formed in the lower portion at the front edge in the toner draining mechanism 37 and the inclined surface is formed between the toner draining port 52 and the bottom surface of the cylindrical portion 38, even in the environment of the high temperature and the high humidity (28 [° C.], 80 [%]) in which the flowability of the toner 16 deteriorates, it is possible to prevent the toner 16 from remaining at the front edge in the toner draining mechanism 37.

Since the toner 16 conveyed by the spiral 51 runs up on the top 61 and is drained from the top 61 in the embodiment, the toner 16 stays in the top 61 and a small amount of toner 16 remains near the top 61.

The third embodiment in the invention in which it is possible to certainly prevent the toner 16 from remaining near the top 61 in order to solve such a problem will now be described.

Figure 12:
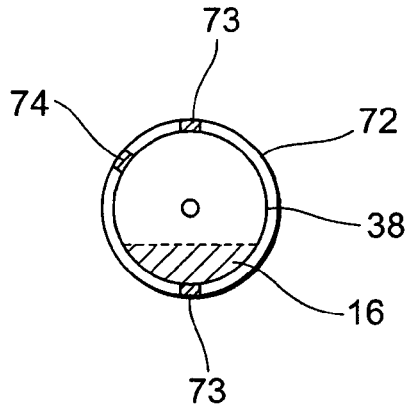
FIG. 12 is a side elevational view of the toner draining mechanism in the third embodiment of the invention.
Figure 13:
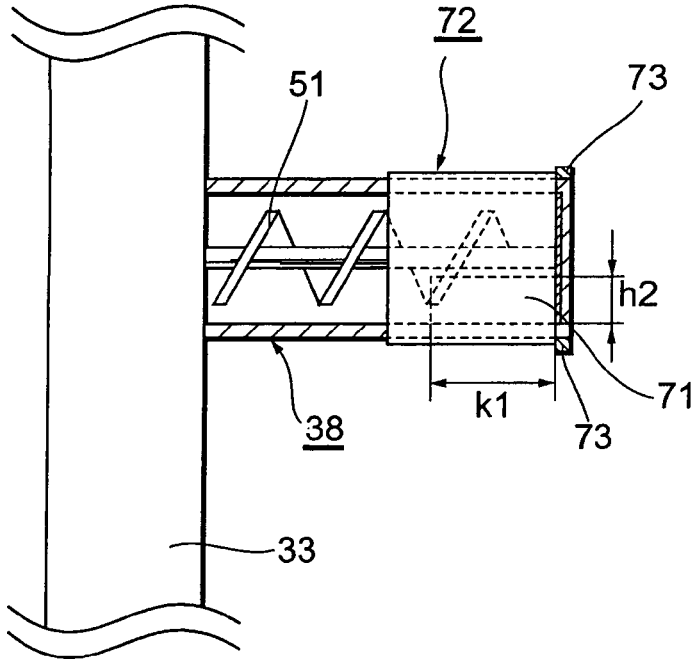
FIG. 13 is a front view showing a second state of the toner draining mechanism in the third embodiment of the invention.

FIG. 11 is a front view showing a first state of a toner draining mechanism in the third embodiment of the invention. FIG. 12 is a side elevational view of the toner draining mechanism in the third embodiment of the invention. FIG. 13 is a front view showing a second state of the toner draining mechanism in the third embodiment of the invention.

In this case, an inner diameter d1 of the cylindrical portion 38 as a hollow member is equal to 12 [mm] and its outer diameter d2 is equal to 14 [mm]. A toner draining port 71 is formed in the lower portion at the front edge (right edge in FIG. 11) of the cylindrical portion 38 so as to be opened downward. A length k1 showing a size in the axial direction of the toner draining port 71 is equal to 8.5 [mm]. The toner draining port 71 is formed in a position that is away upward from the bottom surface of the cylindrical portion 38 by 4 [mm]. That is, a height h2 which is expressed by a distance from the bottom surface of the cylindrical portion 38 to an upper edge of the toner draining port 71 is set to 4 [mm].

In this case, the toner 16 as a developing agent conveyed by the spiral 51 as a third conveying member is drained as it is downward from the toner draining port 71. Therefore, it is possible to certainly prevent the toner 16 from remaining in the lower portion at the front edge of the cylindrical portion 38.

Assuming that the length which is expressed by the size in the axial direction of the non-spiral portion between the front edge of the effective portion of the spiral 51 and the front edge of the cylindrical portion 38 is set to β (FIG. 8), if the length k1 is not larger than the length β, the toner 16 does not immediately drop from the toner draining port 71, is stored in the cylindrical portion 38, and is drained as if it were pushed out by the toner 16 subsequently conveyed by the spiral 51. Therefore, the draining efficiency of the toner 16 deteriorates. If the length k1 is too long, an amount of toner 16 which drops when the toner cartridge 21 is removed increases. Therefore, the dimensions of the toner draining port 71 are set so that the length β is equal to almost ½ of the length k1, in other words, the front edge of the effective portion of the spiral 51 is located almost at the center of the toner draining port 71.

If the height h2 is too large, when the toner cartridge 21 is removed from the printer, if vibration is applied to the toner draining mechanism 37, the toner 16 drops from the toner draining port 71. If the height h2 is set to 3 [mm] or less, the toner 16 collides with the upper edge of the toner draining port 71 and its draining operation is obstructed, so that the draining efficiency deteriorates and the toner 16 remains near the front edge in the cylindrical portion 38. It is, therefore, desirable to set the height h2 to about 4 [mm] as mentioned above.

Since the toner draining port 71 is opened downward, when the toner 16 drops downward in association with the removal of the toner cartridge 21 from the printer, the toner dirties the inside of the printer or is mixed into the new toner 16 in the drum cartridge 10 through the toner supplying port 23. In this case, not only the inside of the printer is dirtied but also an image density decreases, a fog occurs, or a graininess level deteriorates, so that the image quality deteriorates.

To avoid such a drawback, in the embodiment, a drain toner cap 72 as a cap member is slidably arranged to an outer periphery of the cylindrical portion 38 so that it can be freely moved forward or backward in the axial direction (direction of the arrow k). Therefore, the toner draining port 71 is opened or closed by the slide motion of the drain toner cap 72.

Thus, before the toner cartridge 21 is removed from the printer, the toner draining port 71 can be closed by moving the drain toner cap 72. The length k2 in the axial direction of the drain toner cap 72 is set to about 10 [mm], which is slightly larger than the length k1 of the toner draining port 71 so that the toner draining port 71 can be completely blocked. An inner diameter d3 of the drain toner cap 72 is set to 14.2 [mm], which is larger than the outer diameter d2.

A cap stopper rib 73 as a restricting member for restricting the state where the drain toner cap 72 is come out from the cylindrical portion 38 is formed on an outer periphery of the front edge of the cylindrical portion 38. A guide rib 74 is formed in a predetermined portion of an outer peripheral surface of the cylindrical portion 38 so as to be extended in the axial direction. The cap stopper rib 73 and the guide rib 74 are arranged in one or more positions in the circumferential direction of the cylindrical portion 38. The cap stopper rib 73 is also made by the mold in a manner similar to the side panel 33 and formed so that a height from the outer peripheral surface of the cylindrical portion 38 is equal to 0.7 [mm]. Although the cap stopper ribs 73 are arranged in predetermined positions in the circumferential direction of the cylindrical portion 38, they can be formed in a ring shape.

In the printer with the above construction, when the toner cartridge 21 is attached to the printer, the drain toner cap 72 is moved and pressed to the side panel 33. In association with it, the toner draining port 71 is opened and the toner 16 in the toner draining mechanism 37 drops from the toner draining port 71. When the toner cartridge 21 is removed from the printer, the drain toner cap 72 is moved and pressed to the cap stopper rib 73. In association with it, the toner draining port 71 is blocked.

As mentioned above, in the embodiment, when the toner cartridge 21 is removed from the printer, since the toner draining port 71 can be closed, it is possible to prevent the toner 16 near the toner draining port 71 from dropping into the printer.

Since the toner 16 can be smoothly drained from the toner draining port 71, even in the environment of the high temperature and the high humidity (28 [° C.], 80 [%]) in which the flowability of the toner 16 deteriorates, it is possible to prevent the toner 16 from remaining in the front edge in the cylindrical portion 38. Therefore, since the draining of the toner 16 from the toner draining port 71 is not obstructed, such a situation that since the toner 16 is clogged in the cylindrical portion 38 or the grooves of the side panel 33, the toner conveying belt 35 cannot be run does not occur. Thus, the toner 16 removed by the cleaning blade 28 can be smoothly drained and image quality can be improved.

In the embodiment, when the toner cartridge 21 is attached to the printer, it is necessary to move the drain toner cap 72 and push it to the side panel 33. However, at this time, there is a risk that vibration is applied to the cylindrical portion 38 and the toner 16 near the toner draining port 71 drops into the printer.

The fourth embodiment of the invention in which it is possible to prevent the toner 16 near the toner draining port 71 from dropping into the printer when the toner cartridge 21 is attached to the printer in order to solve such a problem will now be described.

Figure 14:
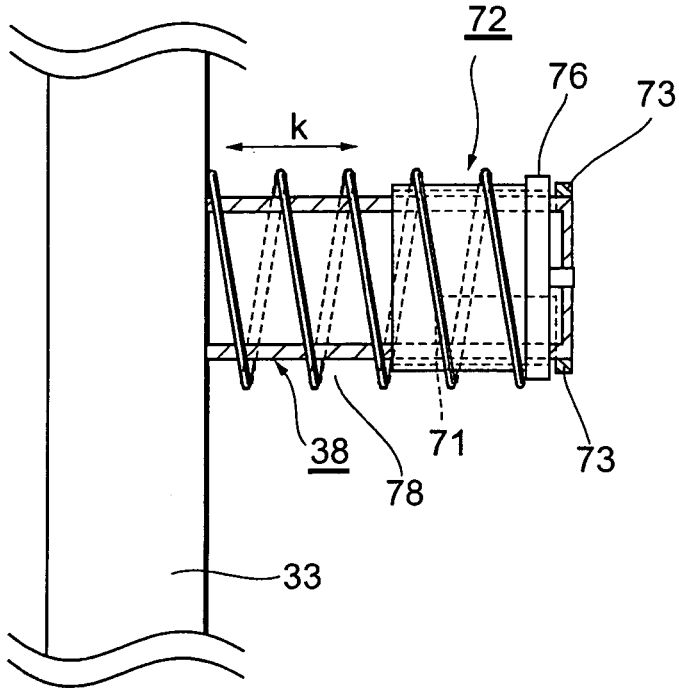
FIG. 14 is a front view showing a first state of a toner draining mechanism in the fourth embodiment of the invention.
Figure 15:
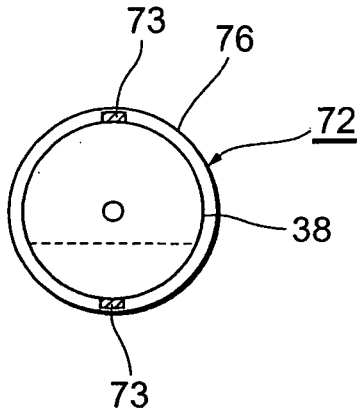
FIG. 15 is a side elevational view of the toner draining mechanism in the fourth embodiment of the invention.
Figure 16:
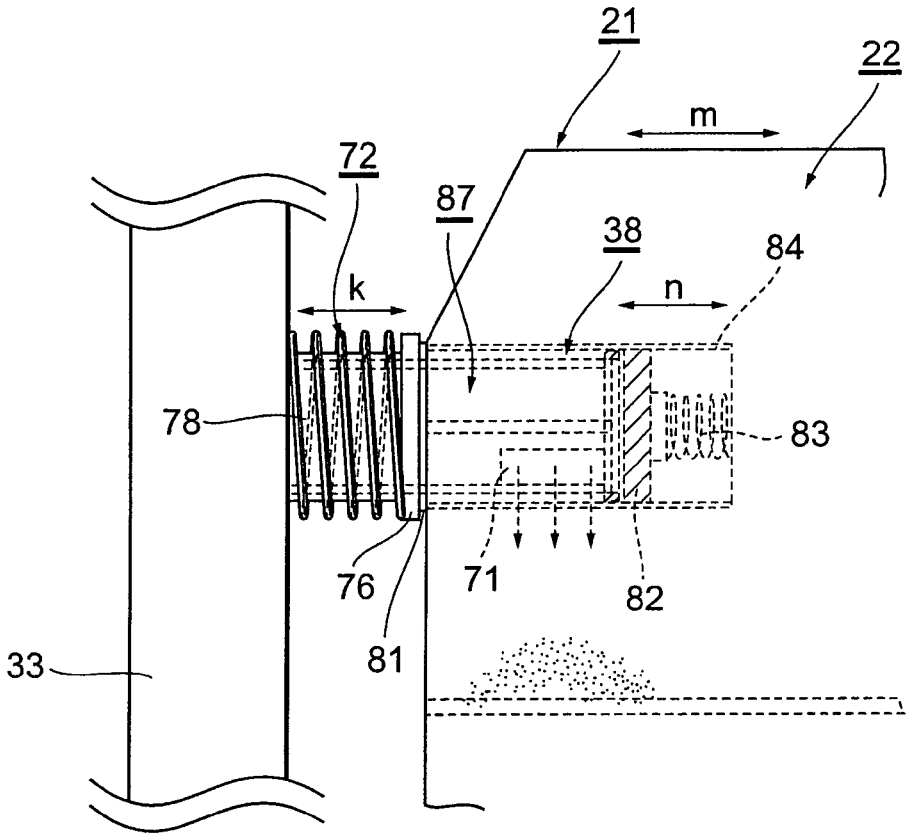
FIG. 16 is a front view showing a second state of the toner draining mechanism in the fourth embodiment of the invention.

FIG. 14 is a front view showing a first state of a toner draining mechanism in the fourth embodiment of the invention. FIG. 15 is a side elevational view of the toner draining mechanism in the fourth embodiment of the invention. FIG. 16 is a front view showing a second state of the toner draining mechanism in the fourth embodiment of the invention.

In this case, a ring-shaped stopper 76 of a predetermined height is formed on the outer peripheral surface of the front edge of the drain toner cap 72 as a cap member. A coil-shaped spring 78 as an urging member is arranged between the stopper 76 and the side panel 33 so as to surround the cylindrical portion 38 as a hollow member and the drain toner cap 72. By an urging force of the spring 78, the drain toner cap 72 is urged toward the cap stopper rib 73 as a restricting member, that is, in the direction where the toner draining port 71 is blocked.

A length showing a dimension in the axial direction of the stopper 76 and a height showing a distance in the radial direction of the stopper 76 are set to 1 [mm]. A length showing dimensions in the axial direction of the cap stopper rib 73 is set to 1 [mm]. A height showing a distance in the radial direction of the cap stopper rib 73 is set to 0.3 [mm]. An inner diameter of the spring 78 is set to a value which is larger than an outer diameter of the drain toner cap 72 by 0.2 [mm].

When the toner cartridge 21 is attached/detached to/from the printer, it is moved in the direction of an arrow (m). An inserting port 81 is formed in the portion of the drain toner vessel 22 corresponding to the toner draining mechanism 37. A guide member 84 is arranged so as to be projected from the inserting port 81 into the drain toner vessel 22. A toner cartridge cover 82 as a cover member to open or close the inserting port 81 is supported by the guide member 84 so as to be movable in the direction of an arrow (n). The toner cartridge cover 82 is urged to the side panel 33 side by an urging force of a spring 83 as an urging member.

In the printer with the above construction, when the toner cartridge 21 is attached to the printer, if the toner cartridge 21 is moved toward the side panel 33, the front edge of the toner draining mechanism 37 pushes the toner cartridge cover 82 against the urging force of the spring 83, thereby opening the inserting port 81. Further, when the toner cartridge 21 is moved toward the side panel 33, the toner cartridge cover 82 is moved backward (moved to the right in FIGS. 14 and 16) while being further pressed by the front edge of the cylindrical portion 38. In association with it, the drain toner cap 72 is moved backward (moved to the left in FIGS. 14 and 16) toward the side panel 33 against the urging force of the spring 78.

At this time, the toner draining port 71 is opened and the toner 16 in the cylindrical portion 38 drops into the drain toner vessel 22 from the toner draining port 71. A notch is formed in the portion of the guide member 84 corresponding to the toner draining port 71.

When the toner cartridge 21 is removed from the printer, if the toner cartridge 21 is moved in such a direction as to be away from the side panel 33, the toner cartridge cover 82 is moved forward (moved to the left in FIGS. 14 and 16) by the urging force of the spring 83. In association with the forward movement, the drain toner cap 72 is moved forward (moved to the right in FIGS. 14 and 16) by the urging force of the spring 78 in such a direction as to be away from the side panel 33 side. By further moving the toner cartridge 21 in such a direction as to be away from the side panel 33, the front edge of the toner draining mechanism 37 is projected to the outside from the inserting port 81 and the toner cartridge cover 82 closes the inserting port 81. During this period of time, the drain toner cap 72 blocks the toner draining port 71.

Since the toner draining port 71 can be automatically opened or closed in the embodiment, in association with the attachment/removal of the toner cartridge 21 to/from the printer as mentioned above, it is possible to prevent the toner 16 near the toner draining port 71 from dropping into the printer.

The drain toner cap 72 in the third and fourth embodiments can be arranged around the cylindrical portion 38 in the first and second embodiments.

The invention is not limited to the above embodiments but many modifications and variations are possible within the spirit and scope of the appended claims of the invention and they are not excluded from the scope of the invention.

Figure 17:
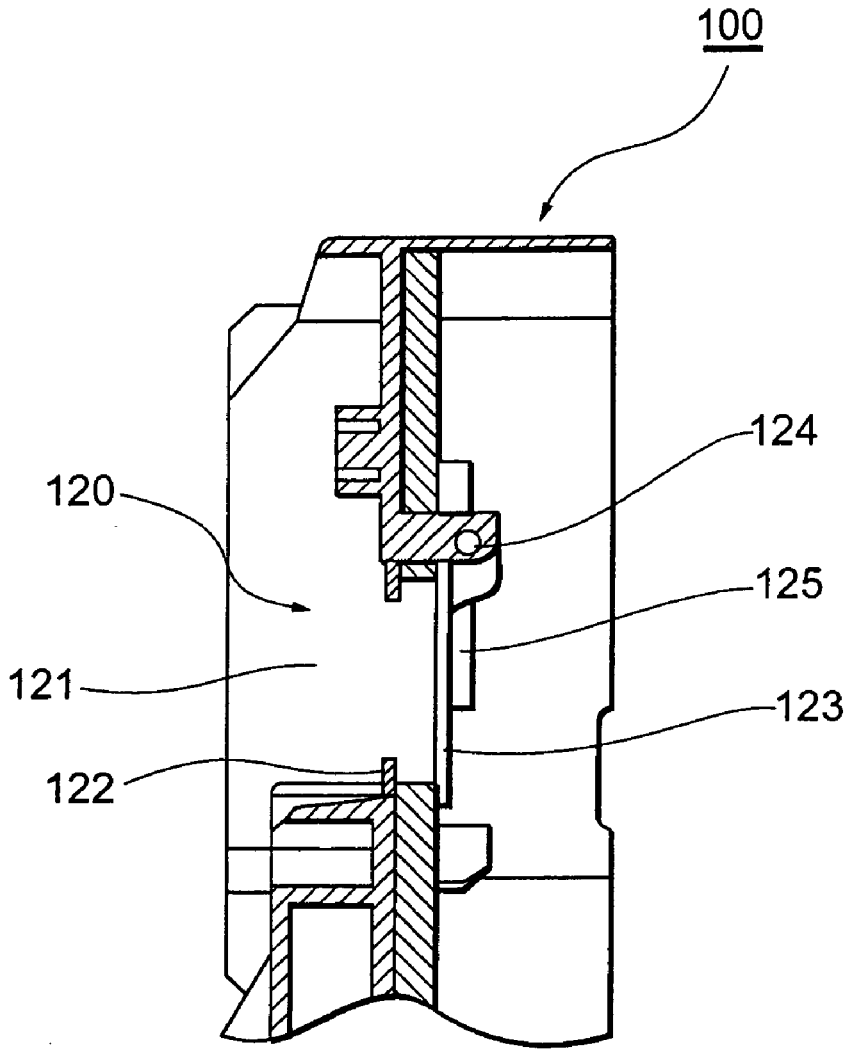
FIG. 17 is a cross sectional view of an attaching mechanism of a collected toner container of the invention.
Figure 20:
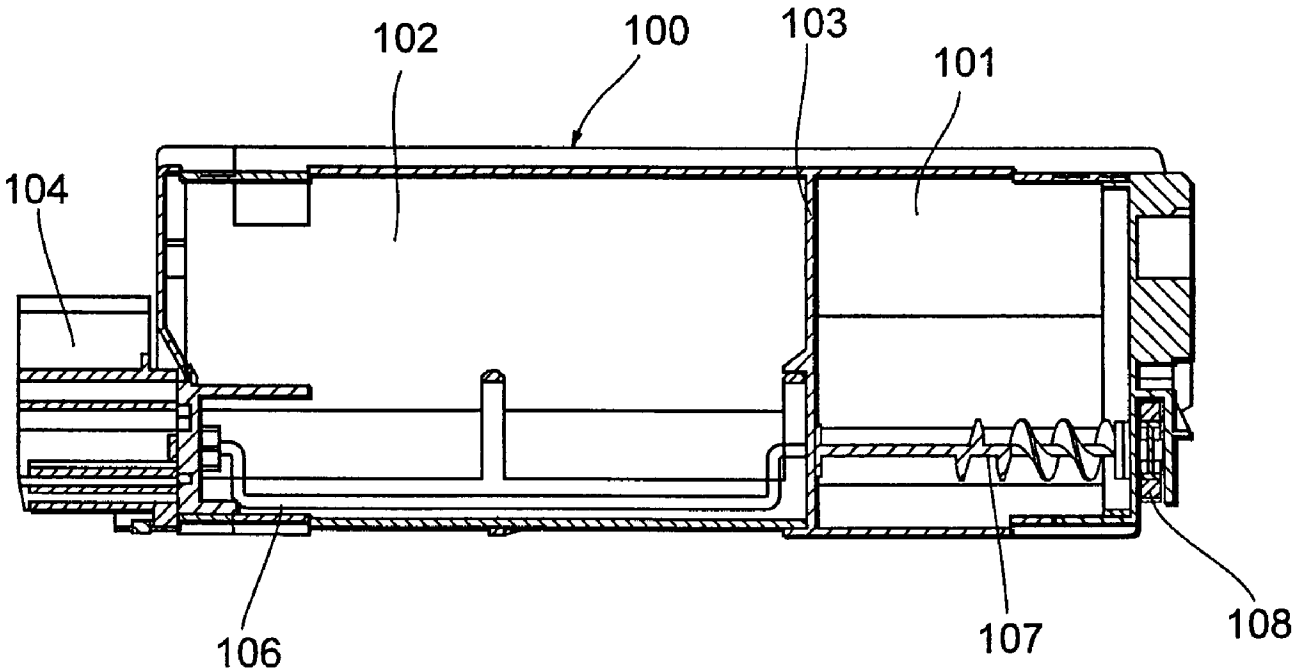
FIG. 20 is a cross sectional view of the collected toner container.
Figure 21:
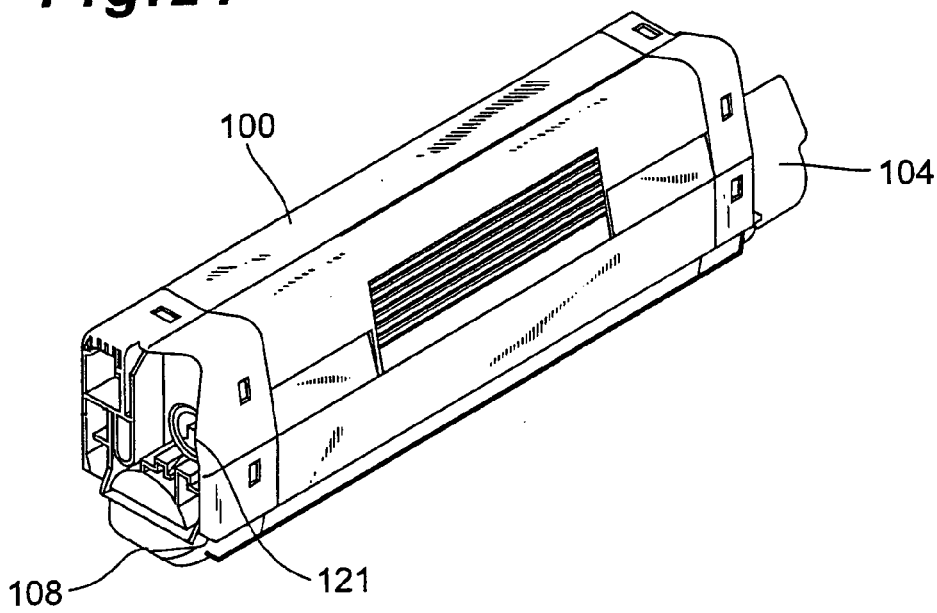
FIG. 21 is a perspective view seen from above of the container.
Figure 22:
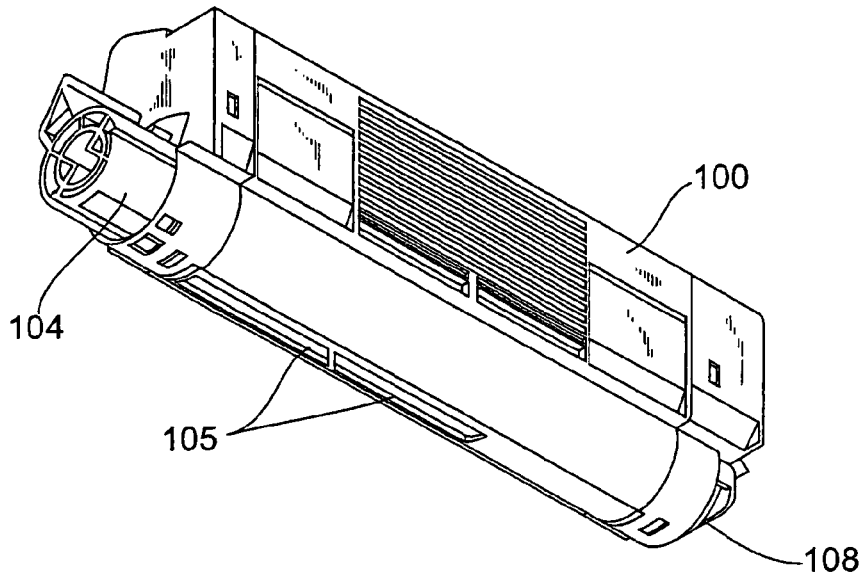
FIG. 22 is a perspective view seen from beneath of the container.

FIG. 17 is a cross sectional view of a main section of a collected toner container 100 according to the invention. FIG. 20 is a cross sectional view showing the whole container 100. FIGS. 21 and 22 are perspective views seen from above and beneath the container 100, respectively.

In FIGS. 20 to 22, reference numeral 101 denotes a drain toner containing portion for containing the collected toner; 102 a toner containing portion for containing unused toner; 103 a partition plate for partitioning the containing portions 101 and 102; 104 a closing lever for opening/closing supplying ports 105 and 105 (FIG. 22) for supplying the unused toner to a drum cartridge 110 for forming an image; 106 an agitating bar for agitating the unused toner in the toner containing portion 102; 107 a spiral bar for conveying the collected toner in the drain toner containing portion 101 to the partition plate 103 side; and 108 a drive gear for rotating the agitating bar 106 and the spiral bar 107. When the gear 108 is attached to the drum cartridge, it is coupled with a driving portion of the drum cartridge and driven.

Figure 23:
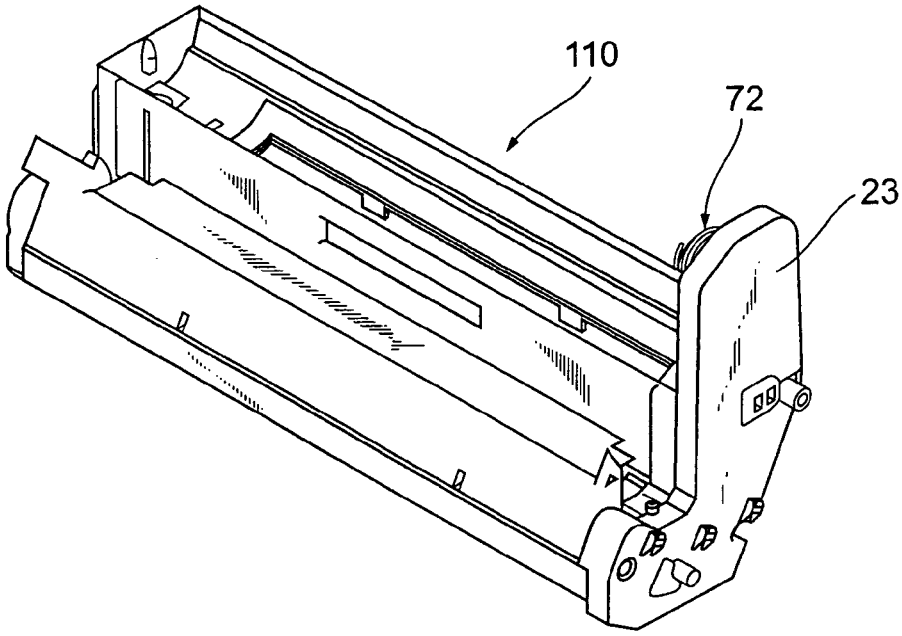
FIG. 23 is a perspective view of a drum cartridge seen from one side thereof.
Figure 24:
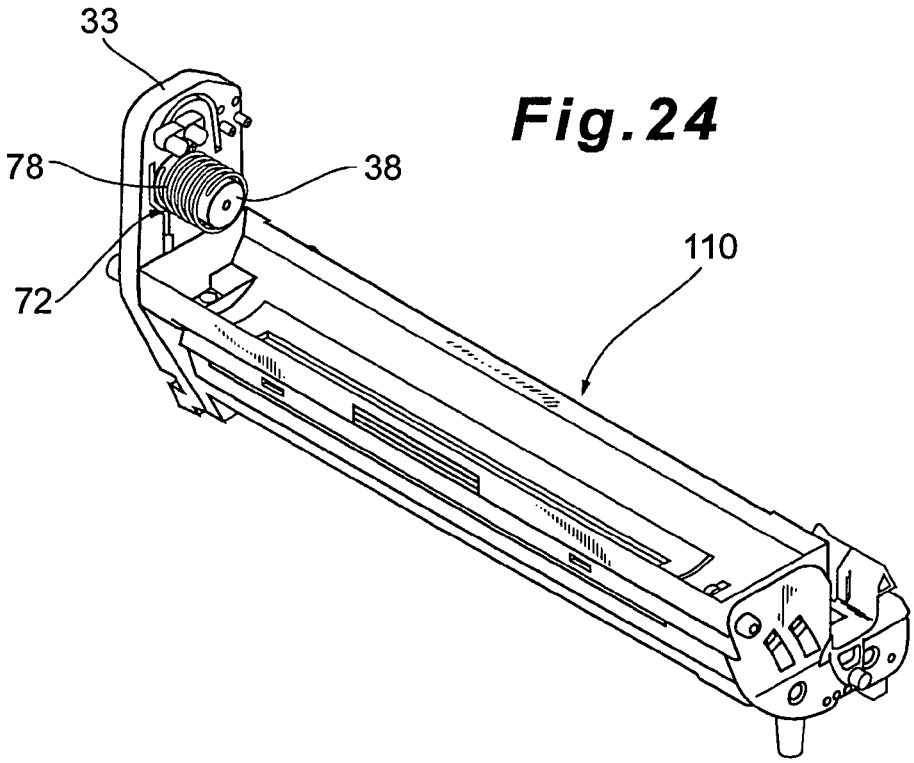
FIG. 24 is a perspective view of the drum cartridge seen from the other side thereof.

FIGS. 23 and 24 show perspective views of the drum cartridge 110, respectively. In the diagrams, reference numeral 33 denotes the side panel and 72 indicates the barrel member for blocking (drain toner cap) shown in FIGS. 14 to 16. The coil spring 78 is attached onto the barrel member 72.

Figure 25:
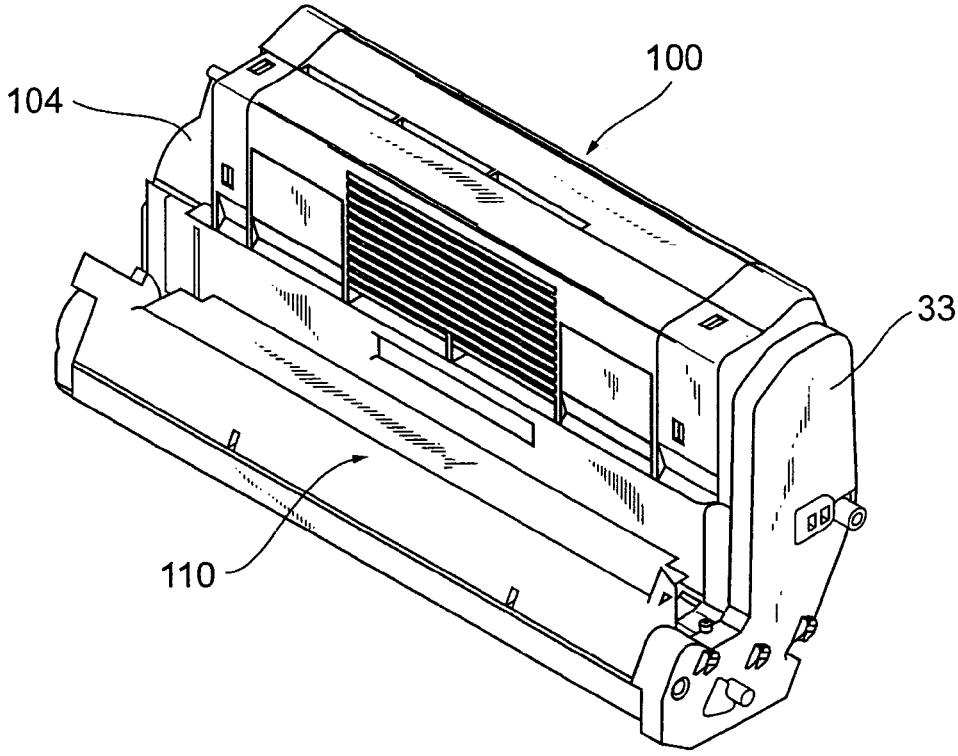
FIG. 25 is a perspective view of the front side showing the state where the collected toner container has been attached to the drum cartridge.
Figure 26:
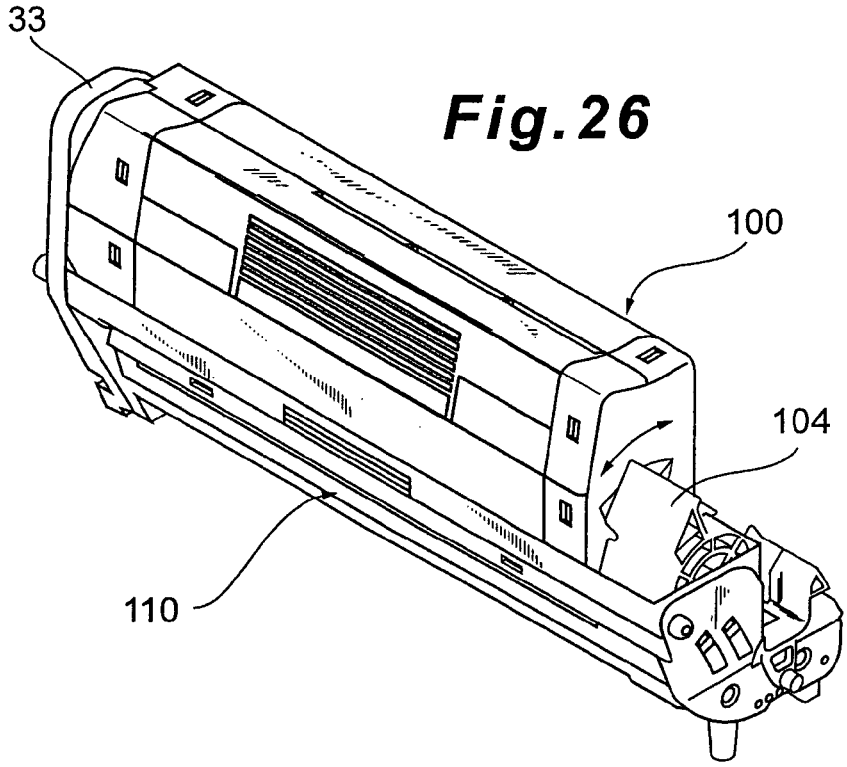
FIG. 26 is a perspective view of the rear side showing the state where the collected toner container has been attached to the drum cartridge.

FIGS. 25 and 26 are perspective views showing the states where the collected toner container 100 has been exchangeably attached to the drum cartridge 110, respectively.

As mentioned above, the drum cartridge 110 to which the collected toner container 100 has been attached is further attached to the printer main body (refer to FIG. 2). Therefore, when the printing operation is started, a drive gear 108 of the collected toner container 100 is driven through a driving unit of the drum cartridge and the agitating bar 106 and the spiral bar 107 are rotated, so that the unused toner is supplied into the drum cartridge 110. Thus, the unused toner is collected as mentioned above and the collected toner is guided to the cylindrical portion 38 of the toner draining mechanism 37.

Returning to FIG. 17, the collected toner container 100 of the invention will be described. That is, the container 100 has an attaching mechanism 120. The attaching mechanism 120 has: an introducing opening 121 for introducing a front edge portion of the cylindrical portion 38; and a contact portion 122 which specifies the introducing opening 121 and with which an edge surface of the blocking barrel member 72 is come into contact.

Figure 18:
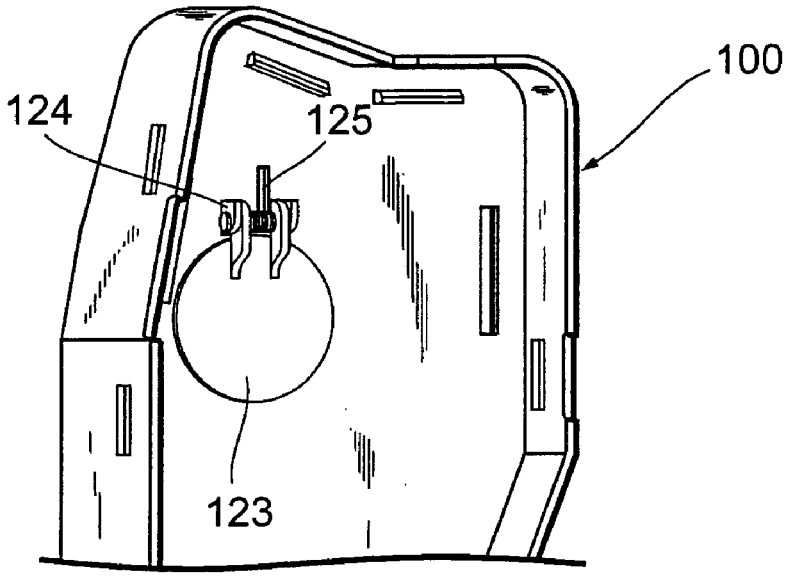
FIG. 18 is a perspective view seen from the back side of the container.

The attaching mechanism 120 further has a disk-shaped rotational cover member 123 which is arranged to an inner position of the introducing opening 121 and closes the opening 121. The rotational cover member 123 is pivotally supported by a pivot pin 124 so that an upper portion is rotatable. As shown in FIGS. 17 and 18, the rotational cover member 123 is always urged by a spring through a torsion spring 125 attached to the pivot pin 124 so as to always close the introducing opening 121.

Figure 19:
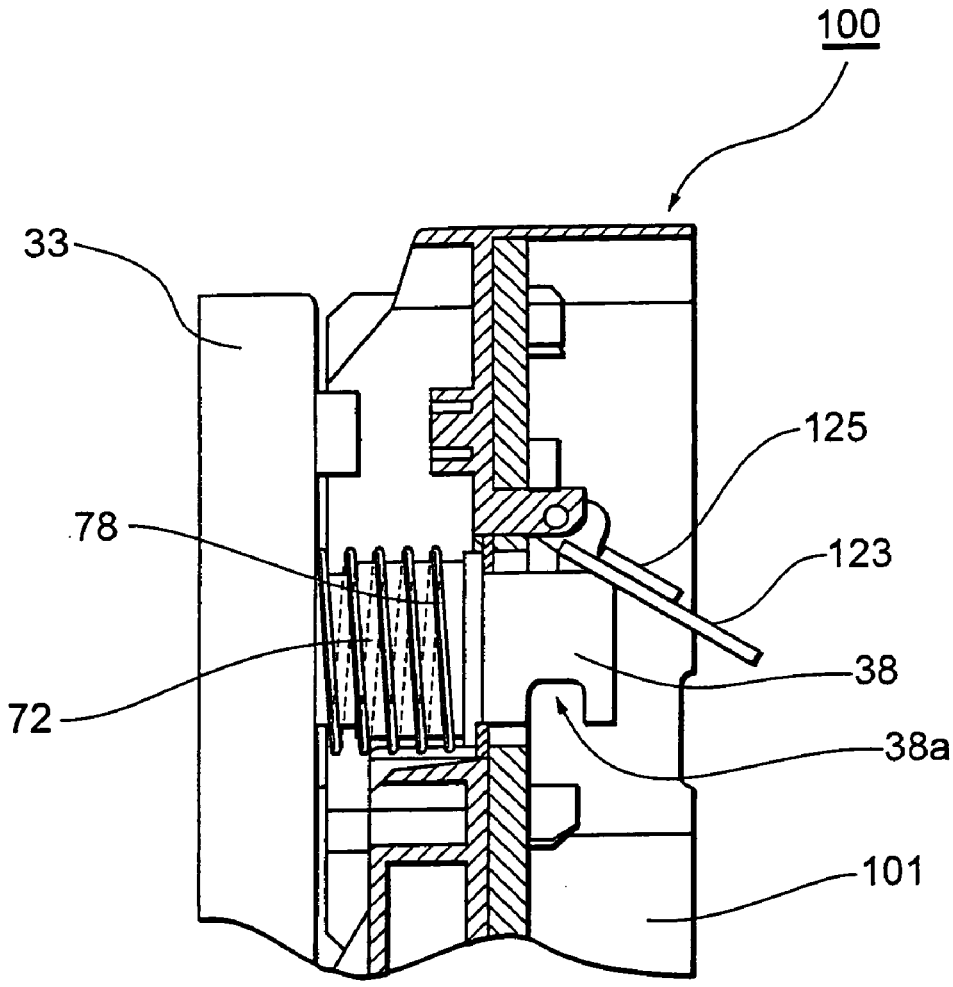
FIG. 19 is a cross sectional view showing the operation of the attaching mechanism of FIG. 17.

The operation of the attaching mechanism of the collected toner container 100 according to the invention will now be described with reference to FIG. 19.

That is, the introducing opening 121 of the container 100 is accurately matched so as to face the cylindrical portion 38 of the toner draining mechanism 37. The container 100 is pressed onto the panel 33 side. Thus, since the cylindrical portion 38 is inserted into the introducing opening 121, the rotational cover member 123 is pressed by a front edge of the cylindrical portion 38 and is rotated through the pivot pin 124.

Since an edge surface of a flange portion of the blocking barrel member 72 on the cylindrical portion 38 is come into contact with the contact portion 122 and the blocking barrel member 72 is slid to the panel 33 side against an elastic force of the coil spring 78, a toner draining port 38*a* of the cylindrical portion 38 is opened. The toner draining port 38*a* is formed in a lower surface of the cylindrical portion 38. Therefore, the collected toner drops from the toner draining port 38*a* and is held into the drain toner containing portion 101.

When the collected toner container 100 is pulled out in such a direction that it is away from the panel 33 in order to exchange the container 100, the cylindrical portion 38 is come out of the introducing opening 121. The rotational cover member 123 is rotated by the elastic force of the torsion spring 125 and closes the introducing opening 121. Since the blocking barrel member 72 is relatively slid on the cylindrical portion 38 by the elastic force of the coil spring 78, when the cylindrical portion 38 is come out, it blocks the toner draining port 38*a*. Therefore, since the toner draining port 38*a* is automatically blocked when the collected toner container 100 is removed, even if vibration is applied to the cylindrical portion 38, the toner in the cylindrical portion 38 does not drop into the image forming apparatus. Since the rotational cover member 123 is rotated while its upper portion is supported, no toner is deposited onto the cover member 123. Therefore, since no toner is deposited onto the peripheral surface of the cylindrical portion 38, the blocking barrel member 72 can be always smoothly slid.

Figure 27A:
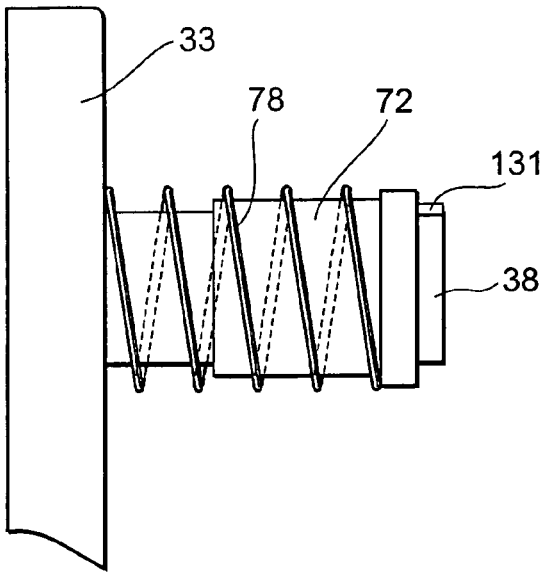
FIG. 27A is a front view of a toner draining mechanism having a part of an attaching mechanism according to another embodiment of the invention.
Figure 27B:
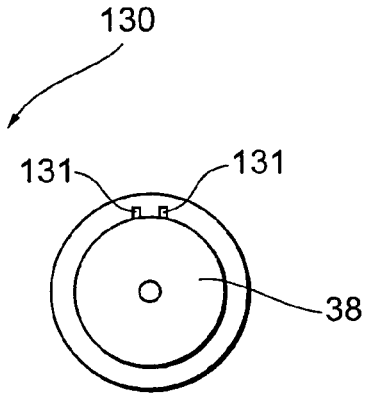
FIG. 27B is a side elevational view of the toner draining mechanism of FIG. 27A.
Figure 28A:
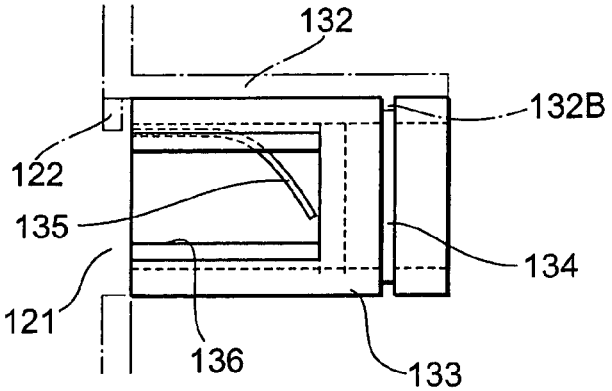
FIG. 28A is a front view of the attaching mechanism according to another embodiment of the invention.
Figure 28B:
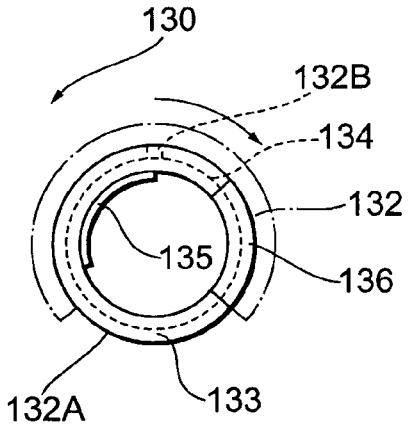
FIG. 28B is a side elevational view of the attaching mechanism according to another embodiment of the invention.
Figure 29:
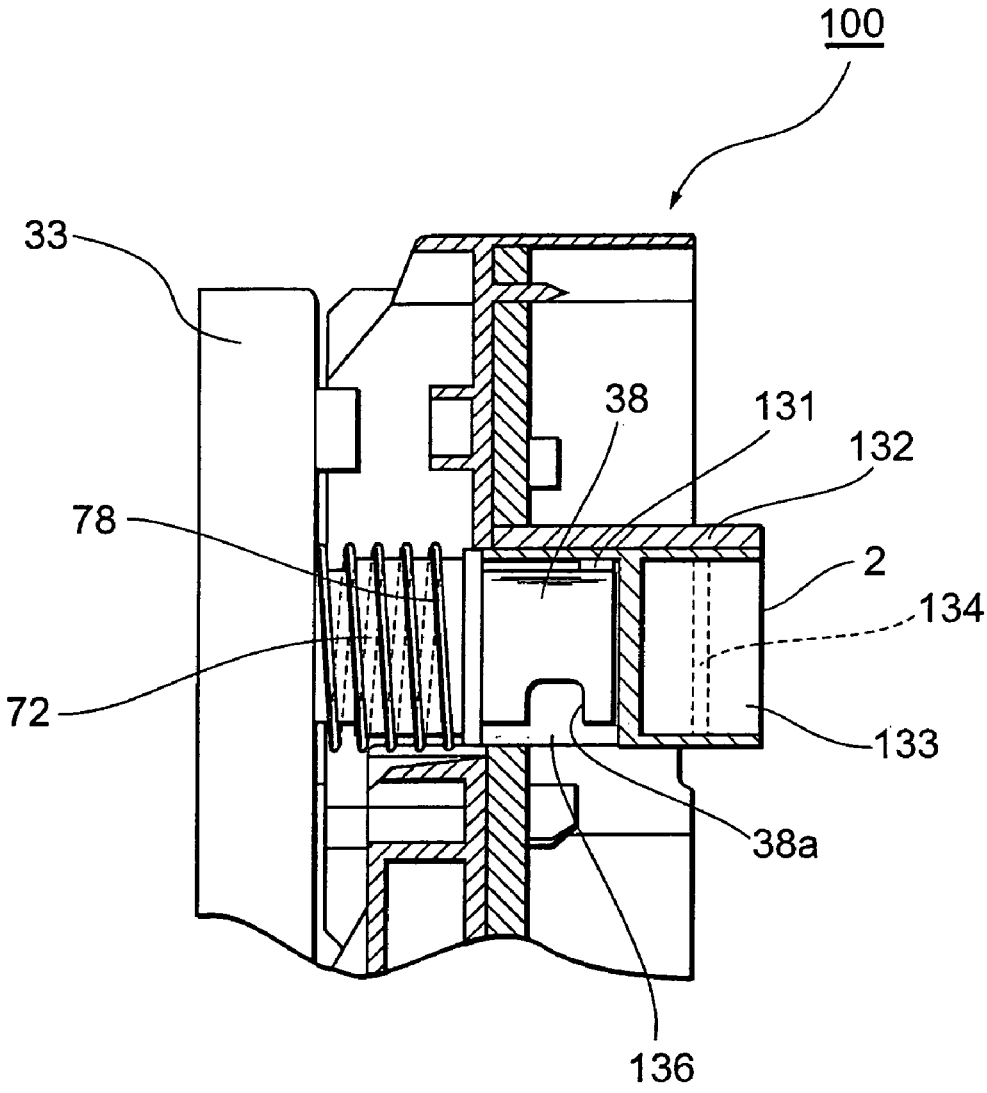
FIG. 29 is a cross sectional view showing the operation of the attaching mechanism according to another embodiment of the invention.

FIGS. 27A, 27B, 28A, and 28B are diagrams showing an attaching mechanism 130 of the collected toner container 100 according to another embodiment of the invention. That is, as shown in FIGS. 27A and 27B, the attaching mechanism 130 has a pair of rotating projections 131 and 131 provided on a peripheral surface of a front edge of the cylindrical portion 38. As shown in FIGS. 28A, 28B, and 29, the attaching mechanism 130 has: a cylindrical containing portion 132 which projects inwardly at the introducing opening 121 of the container 100; and a rotary barrel 133 arranged in the containing portion 132. A toner dropping port 132A which opens at a downward position is formed in the cylindrical containing portion 132. An annular groove 134 is formed on a peripheral surface of a rear edge of the rotary barrel 133. A projection 132B which projects on an inner wall of the cylindrical containing portion 132 is in engagement with the annular groove 134. Thus, the rotary barrel 133 is arranged so as to be rotatable at a fixed position in the cylindrical containing portion 132.

A spiral projecting cam 135 is provided for an inner wall of the rotary barrel 133 and a registration opening 136 in which a part of a peripheral wall has been removed is also provided for the rotary barrel 133. The projecting cam 135 is in engagement with the portion between the rotating projections 131 and 131 mentioned above.

The operation of the attaching mechanism 130 of the invention will now be described with reference to FIG. 29.

That is, the introducing opening 121 of the container 100 is arranged so as to face the cylindrical portion 38. An edge portion of the spiral projecting cam 135 of the rotary barrel 133 is inserted between the rotating projections 131 and 131 at the front edge of the cylindrical portion 38. The container 100 is pressed to the panel 33 side. Thus, since the spiral projecting cam 135 sequentially enters the portion between the rotating projections 131 and 131, the rotary barrel 133 is rotated in the cylindrical containing portion 132 and the registration opening 136 is matched with the toner dropping port 132A of the cylindrical containing portion 132.

Since the edge surface of the flange portion of the blocking barrel member 72 on the cylindrical portion 38 is come into contact with the contact portion 122 (refer to FIG. 28A) and the blocking barrel member 72 is slid to the panel 33 side against the elastic force of the coil spring 78, the toner draining port 38*a* of the cylindrical portion 38 is opened. Therefore, the collected toner drops through the toner draining port 38*a*, the registration opening 136, and the toner dropping port 132A and is held into the drain toner containing portion.

When the collected toner container 100 is pulled out in such a direction that it is away from the panel 33 in order to exchange the container 100, the cylindrical portion 38 is come out of the introducing opening 121. The rotary barrel 133 is rotated in the reverse direction until the spiral projecting cam 135 inserted into the portion between the rotating projections 131 and 131 is removed from the rotating projections 131 and 131. Therefore, the toner dropping port 132A is closed by the peripheral wall of the rotary barrel 133.

Since the blocking barrel member 72 is relatively slid on the cylindrical portion 38 by the elastic force of the coil spring 78, it blocks the toner draining port 38*a*. Therefore, since the toner draining port 38*a* is automatically blocked when the collected toner container 100 is removed, even if vibration is applied to the cylindrical portion 38, the toner in the cylindrical portion 38 does not drop into the image forming apparatus.

Figure 30:
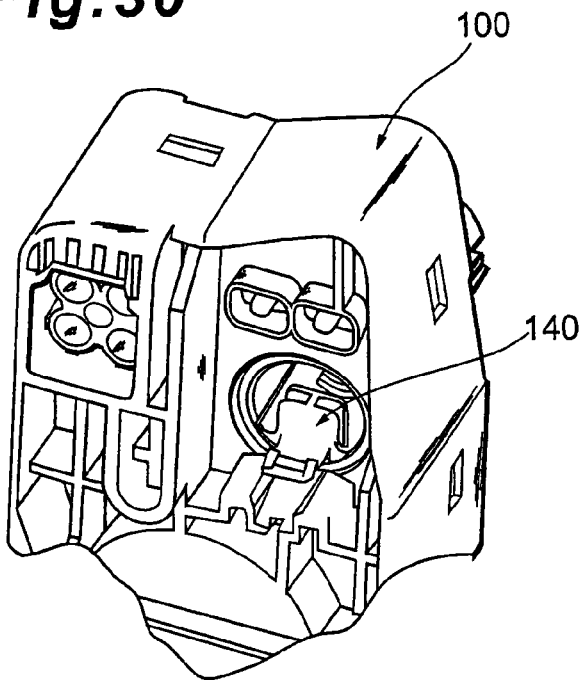
FIG. 30 is a perspective view seen from the rear side of a collected toner container having an attaching mechanism according to further another embodiment of the invention.
Figure 31:
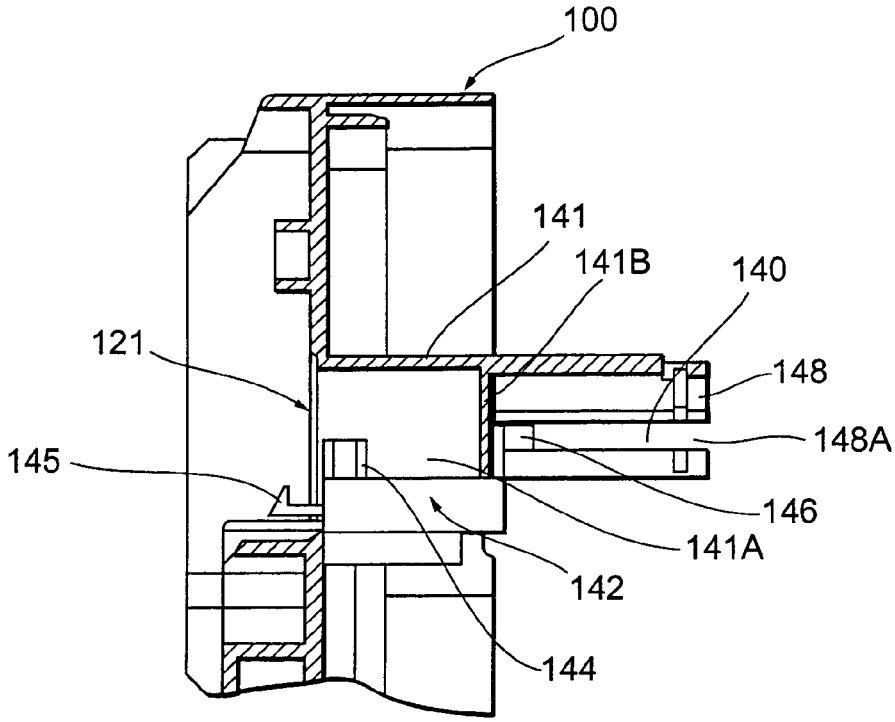
FIG. 31 is a cross sectional view of the attaching mechanism according to further another embodiment of the invention.

FIGS. 30 and 31 are diagrams showing an attaching mechanism 140 according to further another embodiment of the invention. That is, the attaching mechanism 140 has a cylindrical containing portion 141 which projects inwardly at the introducing opening 121 of the container 100; and a mobile member 142 which blocks a toner dropping port 141A which is opened in a lower portion of the containing portion 141.

Figure 32:
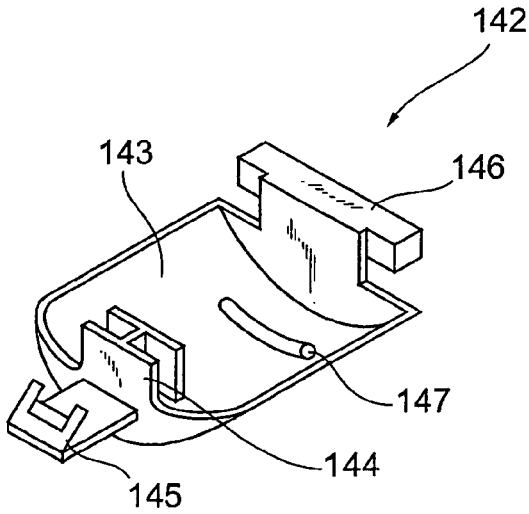
FIG. 32 is a perspective view of a mobile member of the invention.

As shown in FIG. 32, the mobile member 142 comprises: a main body 143 having an arc-shaped cross section which directly blocks the toner dropping port 141A; a stopper 144 which is bent vertically upward from a front portion of the main body 143; a hook portion 145 which extends in the horizontal direction from the front portion of the main body 143; an engagement inserting portion 146 having a T-character shape which is bent vertically upward from a rear portion of the main body 143; and an engagement projecting portion 147 which projects from an inner wall of the main body 143. As shown in FIG. 31, both ends of the engagement inserting portion 146 are inserted into a guide groove 148A formed on a guide member 148 which is extended in the horizontal direction from a restricting plate 141B of the cylindrical containing portion 141. The engagement projecting portion 147 is come into engagement with a lower edge of the restricting plate 141B by proper means.

Figure 33:
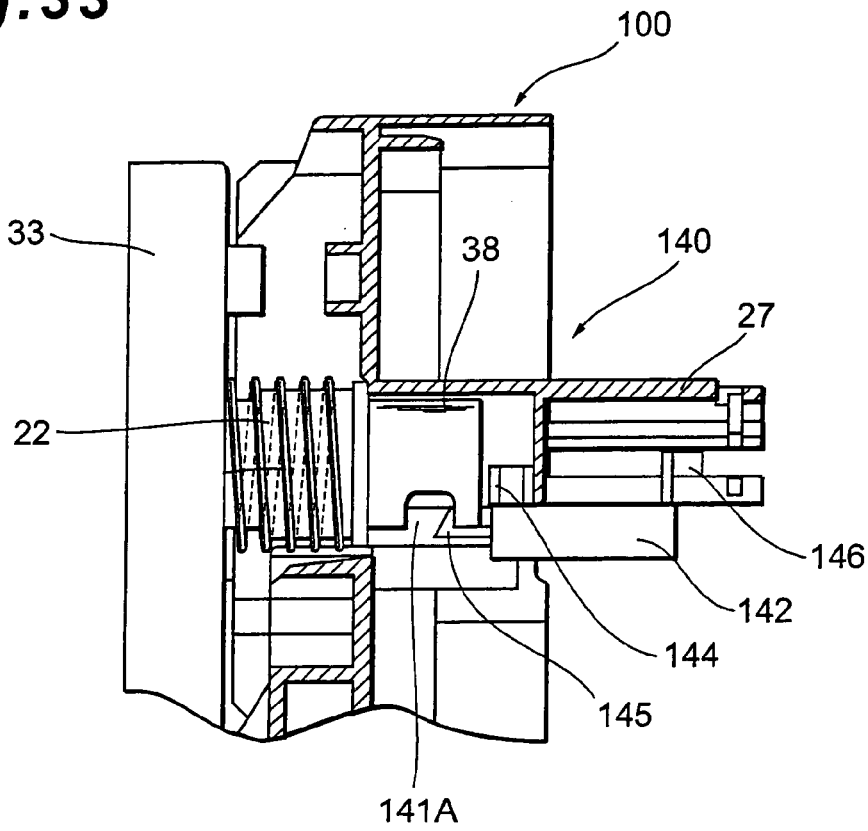
FIG. 33 is a cross sectional view showing the operation of the attaching mechanism according to further another embodiment of the invention.

The operation of the attaching mechanism 140 of the invention will now be described with reference to FIG. 33.

That is, the introducing opening 121 of the container 100 is arranged so as to face the cylindrical portion 38 and the container 100 is pressed to the panel 33 side. Thus, the hook portion 145 of the mobile member 142 is come into contact with the front edge surface of the cylindrical portion 38 and, thereafter, the stopper 144 is come into contact with the front edge surface, so that the mobile member 142 is pressed through the stopper 144 by the relative insertion of the cylindrical portion 38, guided through the engagement inserting portion 146, and moved back from the cylindrical containing portion 141. At a point when the stopper 144 is come into contact with the restricting plate 141B, the insertion of the cylindrical portion 38 is blocked and the toner dropping port 141A of the cylindrical containing portion 141 is opened.

Since the blocking barrel member 72 on the cylindrical portion 38 is come into contact with an edge portion where an edge surface of a flange portion forms the introducing opening 121 and is slid to the panel 33 side against the elastic force of the coil spring 78, the toner draining port 38*a* of the cylindrical portion 38 is also opened. Therefore, the collected toner drops through the toner draining port 38*a* and the toner dropping port 141A and is held into the drain toner containing portion.

When the collected toner container 100 is pulled in such a direction as to be away from the panel 33 in order to exchange the container 100, since the hook portion 145 is in engagement with the toner draining port 38*a*, a stretching force is applied to the mobile member 142 (main body 143) through the hook portion 145 and the mobile member 142 is moved in the opposite direction and returned to the cylindrical containing portion 141. Therefore, the toner dropping port 141A is blocked.

Since the blocking barrel member 72 is relatively slid on the cylindrical portion 38 by the elastic force of the coil spring 78, it blocks the toner draining port 38*a*. Therefore, since the toner draining port 38*a* is automatically blocked when the collected toner container 100 is removed, even if the vibration is applied to the cylindrical portion 38, the collected toner does not drop into the apparatus.

Since the hook portion 145 is made of a flexible material, by pulling the container 100, the hook portion 145 is easily removed from the toner draining port 38*a*.

Figure 34:
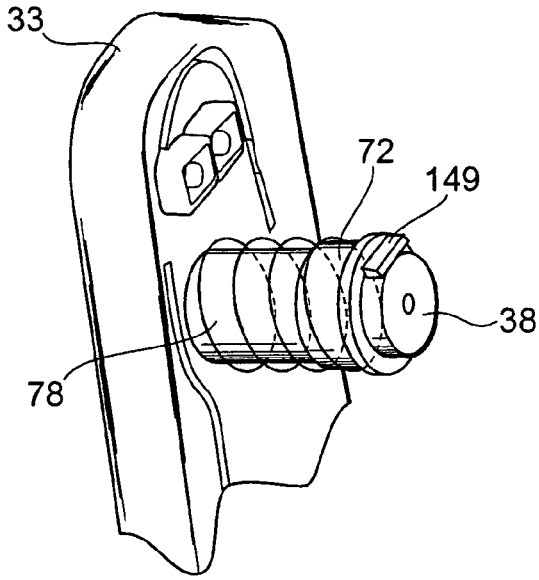
FIG. 34 is a perspective view of a toner draining mechanism having a part of an attaching mechanism according to a modification of the invention.
Figure 35:
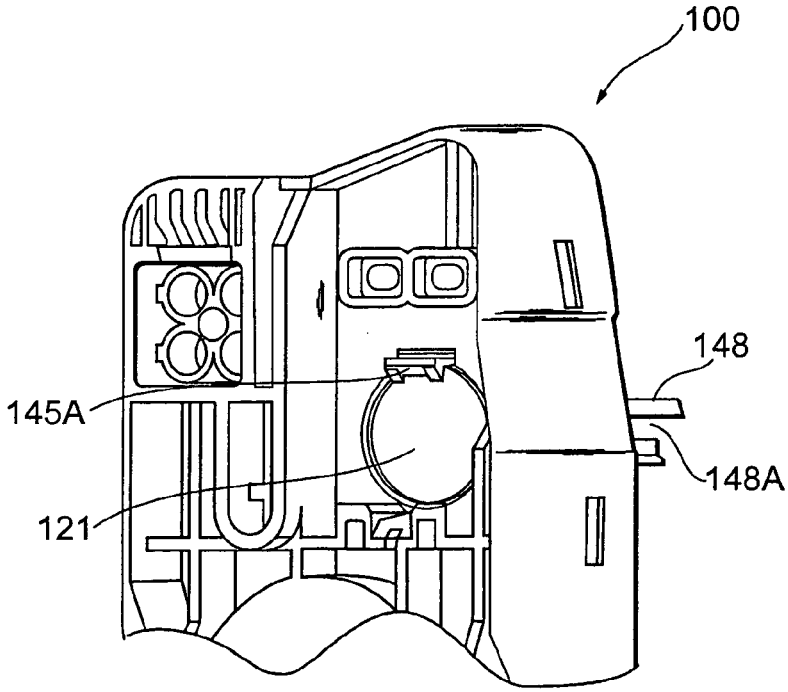
FIG. 35 is a perspective view of the rear side of a collected toner container having the attaching mechanism according to the modification of the invention.
Figure 36:
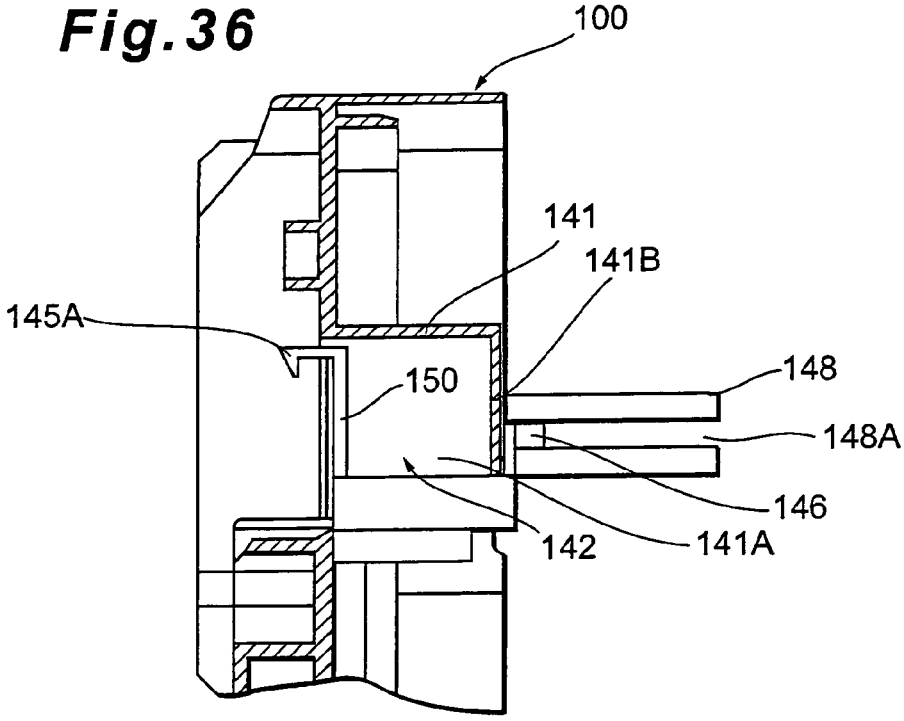
FIG. 36 is a cross sectional view of the attaching mechanism according to the modification of the invention.
Figure 37:
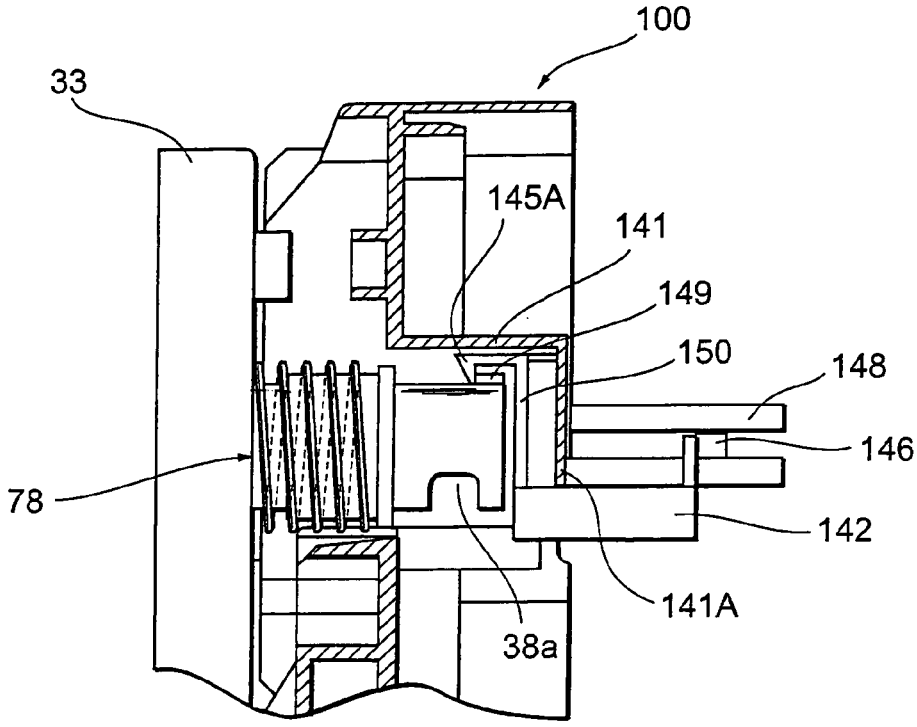
FIG. 37 is a cross sectional view showing the operation of the attaching mechanism according to the modification of the invention.

FIGS. 34 to 36 show a modification of the foregoing attaching mechanism 140.

That is, as shown in FIG. 34, an engagement projection 149 is provided on a peripheral surface of the front edge of the cylindrical portion 38. The mobile member 142 has a standing portion 150 which is bent vertically upward from the front portion of the main body 143 in place of the stopper 144. A hook portion 145A is formed at an upper edge of the standing portion 150. Since the other construction is substantially the same as that of the attaching mechanism 140, the same portions as those in the attaching mechanism 140 are designated by the same reference numerals and their description is omitted here.

In this modification, the engagement projection 149 of the cylindrical portion 38 presses the hook portion 145A and, thereafter, the edge surface of the cylindrical portion 38 presses the standing portion 150. The mobile member 142 is moved until the standing portion 150 is come into contact with the restricting plate 141B, so that the toner dropping port 141A is opened. When the cylindrical portion 38 is relatively pulled out, the hook portion 145A is come into engagement with the engagement projection 149. The engagement projection 149 moves the mobile member 142 in the opposite direction and blocks the toner dropping port 141A.

The present invention is not limited to the foregoing embodiments but many modifications and variations are possible within the spirit and scope of the appended claims of the invention.

What is claimed is:

1. A toner draining mechanism comprising a hollow member and a conveying member which is arranged in said hollow member and conveys toner, wherein a toner draining port for draining the toner conveyed by said conveying member is formed in said hollow member, and said toner draining port is formed above a bottom surface of said hollow member.

2. The toner draining mechanism according to claim 1, wherein an inclined surface is formed between said toner draining port and said bottom surface.

3. A toner draining mechanism comprising a hollow member and a conveying member which is arranged in said hollow member and conveys toner, wherein a toner draining port for draining the toner conveyed by said conveying member is formed in said hollow member, and said toner draining port is formed so that the conveyed toner is drained after the toner reaches a predetermined amount.

4. A toner draining mechanism comprising:

a hollow member;

a conveying member which is arranged in said hollow member and conveys toner;

a cap member which is slidably attached to said hollow member and opens/blocks a toner draining port of said hollow member for draining the toner conveyed by said conveying member; and an urging member which urges said cap member in such a direction as to block said toner draining port; wherein (a) the cap member is movable mounted onto the hollow member;

(b) the cap member has a contacting section to contact with a collected toner container which is mounted attachably and removably to the toner draining mechanism;

(c) when the collected toner container is attached to the toner draining mechanism, through the collected toner container and the contacting section contact, the cap member moves to open the toner draining port.

5. The toner draining mechanism according to claim 4, wherein said cap member is slidably placed in the axial direction of said hollow member.

6. The toner draining mechanism according to claim 4, wherein said contacting section contacts with edge portion of a opening section placed on said collected toner container.

7. The toner draining mechanism according to claim 4, wherein said cap member is placed on the periphery of said hollow member.

8. The toner draining mechanism according to claim 4, wherein said urging member is placed as surrounding said hollow member and said cap member.

9. The collected toner container according to claim 8, wherein said urging member has a coil shape, the inside diameter of said urging member is bigger than the outside diameter of said cap member.

10. The toner draining mechanism according to claim 4, wherein a projection with a predetermined height is provided on the tip portion of said cap member.

11. The toner draining mechanism according to claim 4, wherein a projection is provided on the tip portion of said hollow member to prevent said cap member from coming off said hollow member, and to limit movement of said cap member provided with a force by said urging member.

12. The toner draining mechanism according to claim 4, wherein said toner draining port is placed on the bottom of said hollow member.

13. An image forming apparatus comprising:

an image forming unit which forms a toner image;

a toner collecting unit which collects toner that is not used when said toner image is formed;

a collected toner container which contains the toner collected by said toner collecting unit; and a toner draining mechanism, wherein said toner draining mechanism comprises a hollow member and a conveying member which is arranged in said hollow member and conveys toner, wherein a toner draining port for draining the toner conveyed by said conveying member is formed in said hollow member, and said toner draining port is formed above a bottom surface of said hollow member, wherein the toner collected by said toner collecting unit is sent to said collected toner container through said toner draining mechanism.

14. The image forming apparatus according to claim 13, wherein said collected toner container is detachably connected to said toner draining mechanism.

15. An image forming apparatus comprising:

an image forming unit which forms a toner image;

a toner collecting unit which collects toner that is not used when said toner image is formed;

a collected toner container which contains the toner collected by said toner collecting unit; and a toner draining mechanism, wherein said toner draining mechanism comprises a hollow member and a conveying member which is arranged in said hollow member and conveys toner, wherein a toner draining port for draining the toner conveyed by said conveying member is formed in said hollow member, and said toner draining port is formed so that the conveyed toner is drained after the toner reaches a predetermined amount, wherein the toner collected by said toner collecting unit is sent to said collected toner container through said toner draining mechanism.

16. The image forming apparatus according to claim 15, wherein said collected toner container is detachably connected to said toner draining mechanism.

17. An image forming apparatus comprising:

an image forming unit which forms a toner image;

a toner collecting unit which collects toner that is not used when said toner image is formed; and a collected toner container which contains the toner collected by said toner collecting unit; and a toner draining mechanism, wherein said toner draining mechanism comprises a hollow member; a conveying member which is arranged in said hollow member and conveys toner; a cap member which is slidably attached to said hollow member and opens/blocks a toner draining port of said hollow member for draining the toner conveyed by said conveying member; and an urging member which urges said cover cap member in such a direction as to block said toner draining port, wherein the toner collected by said toner collecting unit is sent to said collected toner container through said toner draining mechanism; and wherein (a) the collected toner container has an opening portion in which the hollow member is inserted;

(b) the cap member is movable mounted onto the hollow member;

(c) the cap member has a contacting section to contact with the collected toner container which is mounted attachably and removably onto the toner draining mechanism;

(d) when the hollow member is inserted into the opening portion, through the collected toner container and the contacting section contact, the cap member moves to open the toner draining port.

18. The image forming apparatus according to claim 17, wherein said collected toner container is detachably connected to said toner draining mechanism.

19. An image forming apparatus comprising:

a toner draining mechanism including a barrel member into which collected toner is guided, a toner conveying means which is arranged in said barrel member and conveys said guided toner to a front edge side of said barrel member, and a toner draining port which is opened in the front edge portion of said barrel member and causes said conveyed toner to drop; and a collected toner container which is exchangeably attached to the front edge portion including said toner draining port of said barrel member and contains the dropped toner, wherein said toner draining mechanism further has a blocking barrel member which is attached onto said barrel member and blocks said toner draining port and a pressing member which presses said blocking barrel member to said front edge portion side so as to block said toner draining port, and said collected toner container has an attaching mechanism including an introducing opening into which said front edge portion is introduced and a contact portion which consists of an edge portion that specifies said introducing opening and allows said blocking barrel member to be slid on said barrel member against an pressure force of said pressing member so as to open said toner draining port; and wherein (a) the blocking barrel member has a contacting section to contact with the contact portion of the collected toner container;

(b) when the barrel member is inserted into the introducing opening, through the contact portion of the collected toner container and the contacting section contact, the blocking barrel member moves to open the toner draining port.

20. The image forming apparatus according to claim 19, further comprising a cartridge for forming an image, and wherein said toner draining mechanism is provided for said cartridge.

21. An image forming apparatus comprising:

a toner draining mechanism including a barrel member into which collected toner is guided, a toner conveying means which is arranged in said barrel member and conveys said guided toner to a front edge side of said barrel member, and a toner draining port which is opened in the front edge portion of said barrel member and causes said conveyed toner to drop; and a collected toner container which is exchangeably attached to the front edge portion including said toner draining port of said barrel member and contains the dropped toner, wherein said toner draining mechanism further has a blocking barrel member which is slidably attached onto said barrel member and blocks said toner draining port and an elastic member which elastically presses said blocking barrel member to said front edge portion side so as to block said toner draining port, and said collected toner container has an attaching mechanism including an introducing opening into which said front edge portion is introduced and a contact portion which consists of an edge portion that specifies said introducing opening and allows said blocking barrel member to be slid on said barrel member against an elastic force of said elastic member so as to open said toner draining port; and wherein (a) the locking barrel member has a contacting section to contact with the contact portion of the collected toner container;

(b) when the barrel member is inserted into the introducing opening, through the contact portion of the collected toner container and the contacting section contact, the blocking barrel member moves to open the toner draining port.

22. The image forming apparatus according to claim 21, further comprising a cartridge for forming an image, and wherein said toner draining mechanism is provided for said cartridge.

23. A collected toner container which is exchangeably attached to a toner draining mechanism and contains toner which drops, said toner draining mechanism comprising:

a barrel member into which the collected toner is guided;

a toner conveying means which is arranged in said barrel member and conveys said guided toner to a front edge side of said barrel member;

a toner draining port which is opened in the front edge portion of said barrel member and causes said conveyed toner to drop;

a blocking barrel member which is slidably attached onto said barrel member and blocks said toner draining port; and an elastic member which elastically presses said blocking barrel member to said front edge portion side so as to block said toner draining port, wherein said collected toner container comprises an attaching mechanism including:

an introducing opening into which said front edge portion is introduced; and a contact portion which consists of an edge portion that specifies said introducing opening and allows said blocking barrel member to be slid on said barrel member against an elastic force of said elastic member so as to open said toner draining port; and wherein (a) the blocking banal member has a contacting section to contact with the contact portion of the collected toner container;

(b) when the barrel member is inserted into the introducing opening, through the contact portion of the collected toner container and the contacting section contact, the blocking barrel member moves to open the toner draining port.

24. The collected toner container according to claim 23, wherein said attaching mechanism includes a rotational cover member which is pivotally supported in an inner portion of said introducing opening so that an upper edge is rotatable, blocks said introducing opening through elastic member, and is rotated in an opening direction against the elastic force of said elastic member by a pressing force of the front edge of said barrel member introduced to said introducing opening.

25. The collected toner container according to claim 23, wherein said attaching mechanism further includes:

a cylindrical portion into which the front edge portion of said barrel member introduced to said introducing opening is inserted and which has a toner dropping port that is opened downward;

a mobile blocking cover which is arranged to said cylindrical portion so as to be movable in its axial direction and blocks said toner dropping port; and cover moving means which is come into engagement with said mobile blocking cover by the insertion of said front edge portion into said cylindrical portion and moves said mobile blocking cover so as to open said toner dropping port.

26. The collected toner container according to claim 25, wherein said mobile blocking cover has a coupling section to couple with said barrel member;

while said barrel member is inserted into said cylindrical portion, through said coupling section couples with said barrel member, said mobile blocking cover moves to open said toner dropping port;

while said barrel member is pulled out of said cylindrical portion, said mobile blocking cover moves to close said toner dropping port.

27. The collected toner container according to claim 26, wherein while said barrel member is inserted into said cylindrical portion, through said barrel member presses said coupling section, said mobile blocking cover moves to open said toner dropping port.

28. The collected toner container according to claim 26, wherein while said barrel member is pulled out of said cylindrical portion, the coupling section coupling with the barrel member is pulled, said mobile blocking cover moves to close said toner dropping port.

29. The collected toner container according to claim 23, wherein said attaching mechanism further includes:

a cylindrical portion into which the front edge portion of said barrel member introduced to said introducing opening is inserted and which has a toner dropping port that is opened downward;

a mobile blocking cover which is arranged to said cylindrical portion so as to be movable in its axial direction and blocks said toner dropping port;

a force providing member which provides said mobile blocking cover with force along a direction said introducing opening closes;

a cover moving means which, with said barrel member is inserted into said cylindrical portion and said barrel member contacts to said mobile blocking cover, makes said mobile blocking cover slide to open said introducing opening and to move to a position enabling said toner dropping port to open.

30. The collected toner container according to claim 23, wherein said attaching mechanism further includes a cylindrical portion into which the front edge portion of said barrel member introduced to said introducing opening is inserted and which has a toner dropping port that is opened downward;

a mobile blocking cover which is arranged to said cylindrical portion so as to be movable in its axial direction and blocks said toner dropping port;

said mobile blocking cover has a coupling section to couple with said barrel member;

while said barrel member is inserted into said cylindrical portion, through said coupling section couples with said barrel member, said mobile blocking cover moves to open said toner dropping port;

while said barrel member is pulled out of said cylindrical portion, said mobile blocking cover moves to close said toner dropping port.

31. The collected toner container according to claim 30, wherein while said barrel member is inserted into said cylindrical portion, through said barrel member presses said coupling section, said mobile blocking cover moves to open said toner dropping port.

32. A collected toner container which is exchangeably attached to a toner draining mechanism and contains toner which drops, said toner draining mechanism comprising:

a barrel member into which the collected toner is guided;

toner conveying means which is arranged in said barrel member and conveys said guided toner to a front edge side of said barrel member;

a toner draining port which is opened in the front edge portion of said barrel member and causes said conveyed toner to drop;

a blocking barrel member which is slidably attached onto said barrel member and blocks said toner draining port; and an elastic member which elastically presses said blocking barrel member to said front edge portion side so as to block said toner draining port, wherein said collected toner container comprises an attaching mechanism including;

an introducing opening into which said front edge portion is introduced; and a contact portion which consists of an edge portion that specifies said introducing opening and allows said blocking barrel member to be slid on said barrel member against an elastic force of said elastic member so as to open said toner draining port;

wherein said attaching mechanism further includes:

a cylindrical portion into which the front edge portion of said barrel member introduced to said introducing opening is inserted and which has a toner dropping port that is opened downward;

a rotary cap which is rotatably arranged in said cylindrical portion; and cap rotating means which rotates said rotary cap by a predetermined amount by the insertion of said front edge portion into said cylindrical portion, and said rotary cap has an opening which is matched with said toner dropping port by the rotation of said predetermined amount and allows the toner to drop.

* * * * *